US010472038B1

(12) United States Patent
Walgren et al.

(10) Patent No.: US 10,472,038 B1
(45) Date of Patent: Nov. 12, 2019

(54) HYDRAULIC FLUID RESERVOIRS FOR STEERING ACTUATORS ON OUTBOARD MOTORS

(71) Applicant: Brunswick Corporation, Mettawa, IL (US)

(72) Inventors: Timothy P. Walgren, Wales, WI (US); Tyler J. Nackers, Oshkosh, WI (US); Kerry J. Treinen, Malone, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/223,344

(22) Filed: Dec. 18, 2018

(51) Int. Cl.
*B63H 20/32* (2006.01)
*B63H 20/10* (2006.01)
*B63H 20/12* (2006.01)

(52) U.S. Cl.
CPC ..... *B63H 20/32* (2013.01); *B63H 20/10* (2013.01); *B63H 20/12* (2013.01)

(58) Field of Classification Search
CPC ..... B63H 20/00; B63H 20/08; B63H 20/12; B63H 20/32; B63H 25/00; B63H 25/06; B63H 25/22; B63H 25/28; B63H 25/30; B63H 5/00; B63H 5/125; B63H 21/00; B63H 21/21; B63H 21/22
USPC ..... 114/144 R; 440/58, 61 C, 61 D, 61 R, 440/61 S
See application file for complete search history.

(56) References Cited

U.S. PATENT DOCUMENTS 4,744,777 A * 5/1988 Ferguson ..... B63H 25/20 440/61 R
5,392,690 A 2/1995 Hundertmark
5,509,369 A * 4/1996 Ford ..... B63H 21/265 440/61 R
6,113,444 A * 9/2000 Ritger ..... B63H 21/265 440/61 S
6,402,577 B1 6/2002 Treinen et al.
6,821,168 B1 11/2004 Fisher et al.
7,255,616 B1 8/2007 Caldwell
7,364,482 B1 * 4/2008 Wong ..... B63H 25/28 440/1
7,699,674 B1 4/2010 Wald et al.
8,046,122 B1 10/2011 Barta et al.
(Continued)

OTHER PUBLICATIONS

Buyers Hydraulic Breather Cap, Northern Tool + Equipment, www.northerntool.com, website visited Jul. 18, 2018.

*Primary Examiner* — Lars A Olson
(74) *Attorney, Agent, or Firm* — Andrus Intellectual Property Law, LLP

(57) ABSTRACT

An outboard motor is for propelling a marine vessel in water and can be trimmed about a trim axis into and between a raised position in which the outboard motor is fully trimmed up out of the water and a lowered position in which the outboard motor is fully trimmed down into the water. The outboard motor has a hydraulic steering actuator for steering the outboard motor about steering axis and a reservoir mounted on the outboard motor and containing hydraulic fluid for the hydraulic steering actuator. A vent opening vents the reservoir to atmosphere and is located on top of the reservoir and closer to the back of the outboard motor than the front of the outboard motor so that the vent opening does not become covered by the hydraulic fluid when the outboard motor is trimmed into and out of the raised and lowered positions.

20 Claims, 18 Drawing Sheets

(56) References Cited

U.S. PATENT DOCUMENTS

| | | | | |
|---|---|---|---|---|
| 9,849,957 | B1 | 12/2017 | Grahl et al. | |
| 9,944,385 | B2 | 4/2018 | Lee et al. | |
| 2006/0278459 | A1* | 12/2006 | Iwaki | B60K 17/356 180/242 |

* cited by examiner

HYDRAULIC FLUID RESERVOIRS FOR STEERING ACTUATORS ON OUTBOARD MOTORS

FIELD

The present disclosure relates to marine engines and particularly to outboard motors having a hydraulic steering actuator and an associated reservoir for hydraulic fluid.

BACKGROUND

The following U.S. patents are incorporated herein by reference:

U.S. Pat. No. 9,944,385 discloses a system for controlling trim position of a marine propulsion device on a marine vessel, which includes a trim actuator having a first end configured to couple to the marine propulsion device and a second end configured to couple to the marine vessel. A controller controls position of the trim actuator between an extended position wherein the propulsion device is trimmed up with respect to the vessel and a retracted position wherein the propulsion device is trimmed down with respect to the vessel. A shock relief mechanism overrides position control by the controller and allows extension of the trim actuator upon the occurrence of an overpressure event. An arresting mechanism, when activated, prevents extension of the trim actuator beyond a certain limit. The controller selectively activates the arresting mechanism in response to a determination that the propulsion device is being commanded in reverse. Methods for controlling trim position are also included.

U.S. Pat. No. 9,849,957 discloses a steering actuator for steering an outboard marine engine about a steering axis. The steering actuator has a housing; a piston device that is disposed in the housing, wherein hydraulic actuation of the piston device causes the outboard marine engine to pivot about the steering axis; and a valve device that is disposed in the housing. The valve device controls a flow of a hydraulic fluid to move the piston device in a first piston direction and to move the piston device in an opposite, second piston direction. Movement of the piston device in the first piston direction causes the outboard marine engine to pivot in a first pivot direction and movement of the piston device in the second piston direction causes the outboard marine engine to pivot in an opposite, second pivot direction.

U.S. Pat. No. 8,046,122 discloses a control system for a hydraulic steering cylinder that utilizes a supply valve and a drain valve. The supply valve is configured to supply pressurized hydraulic fluid from a pump to either of two cavities defined by the position of a piston within the hydraulic cylinder. A drain valve is configured to control the flow of hydraulic fluid away from the cavities within the hydraulic cylinder. The supply valve and the drain valve are both proportional valves in a preferred embodiment of the present invention in order to allow accurate and controlled movement of a steering device in response to movement of a steering wheel of a marine vessel.

U.S. Pat. No. 7,699,674 discloses a steering mechanism that connects the shaft of an actuator with a piston rod of a hydraulic cylinder and provides a spool valve in which the spool valve housing is attached to the hydraulic cylinder and the shaft of the actuator extends through a cylindrical opening in a spool of the spool valve. The connector is connectable to a steering arm of a marine propulsion device and the spool valve housing is connectable to a transom of a marine vessel.

U.S. Pat. No. 7,255,616 discloses a steering system for a marine propulsion device that eliminates the need for two support pins and provides a hydraulic cylinder with a protuberance and an opening which cooperate with each other to allow a hydraulic cylinder's system to be supported by a single pin for rotation about a pivot axis. The single pin allows the hydraulic cylinder to be supported by an inner transom plate in a manner that allows it to rotate in conformance with movement of a steering arm of a marine propulsion device.

U.S. Pat. No. 6,821,168 discloses an outboard motor having an internally contained cylinder and moveable piston. The piston is caused to move by changes in differential pressure between first and second cavities within the cylinder. By adding a hydraulic pump and a steering valve, the hydraulic steering system described in U.S. Pat. No. 6,402,577 is converted to a power hydraulic steering system by adding a hydraulic pump and a steering valve to a manual hydraulic steering system.

U.S. Pat. No. 6,402,577 discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

U.S. Pat. No. 5,392,690 discloses a marine hydraulic system for operation of a power steering assembly, which includes a pressure accumulator to provide pressurized hydraulic fluid and valving that permits the transfer of hydraulic fluid within the cylinder to provide efficient use of hydraulic fluid.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples disclosed herein, an outboard motor is for propelling a marine vessel in water. The outboard motor can be trimmed about a trim axis into and between a raised position in which the outboard motor is fully trimmed up out of the water and a lowered position in which the outboard motor is fully trimmed down into the water The outboard motor has a hydraulic power steering actuator for steering the outboard motor about steering axis and a reservoir mounted on the outboard motor and containing hydraulic fluid for the hydraulic power steering actuator. A vent opening vents the reservoir to atmosphere and is located on top of the reservoir and closer to the back of the outboard motor than the front of the outboard motor so that the vent opening does not become covered by the hydraulic fluid when the outboard motor is trimmed into and out of the raised and lowered positions, including but not limited to for storage.

BRIEF DESCRIPTION OF THE DRAWINGS

The present disclosure is described with reference to the following Figures. The same numbers are used throughout the Figures to reference like features and like components. Unless otherwise specifically noted, articles depicted in the drawings are not necessarily drawn to scale.

DETAILED DESCRIPTION OF THE DRAWINGS

Figure 1:
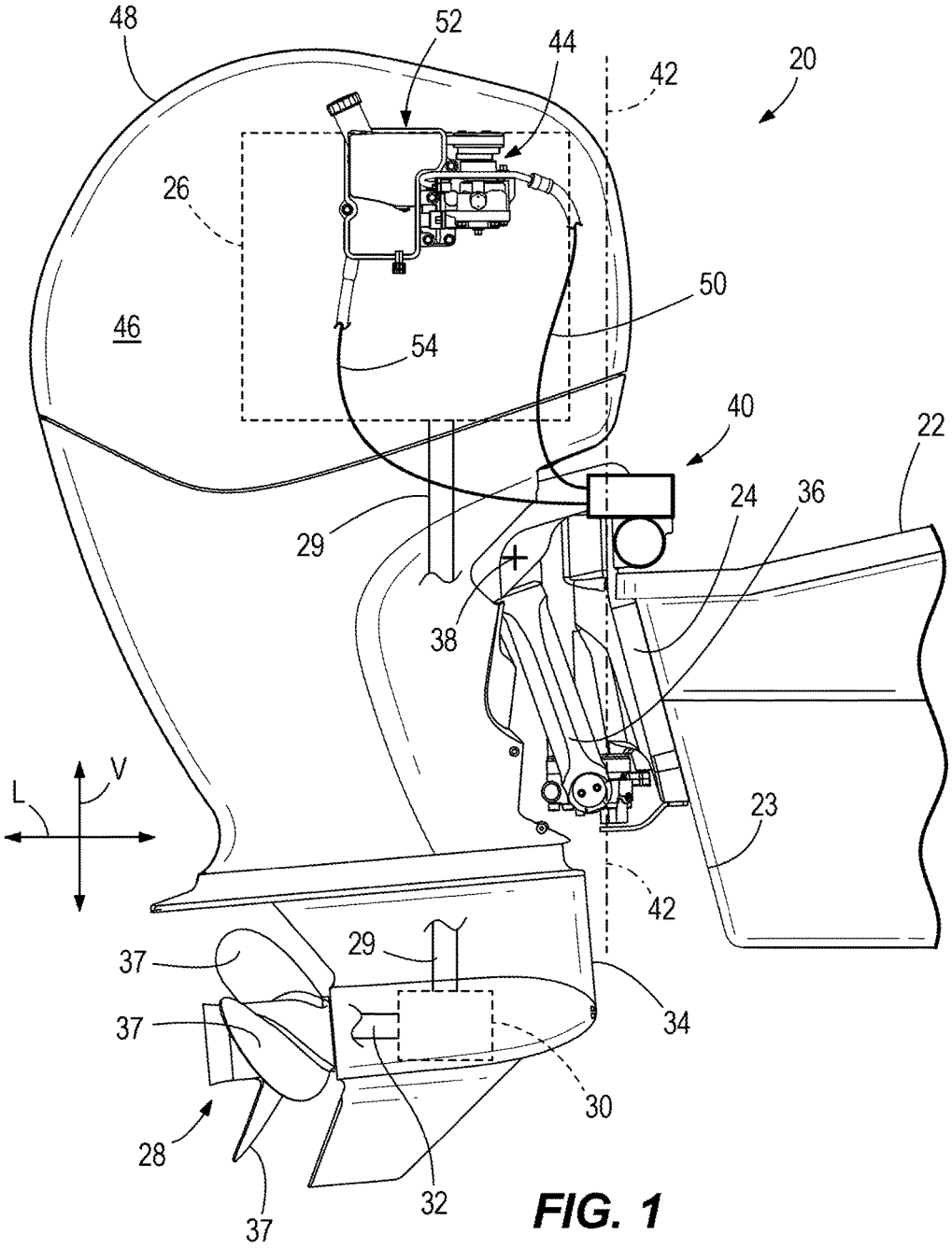
FIG. 1 is a side view of a marine vessel and an outboard motor having a first example of a hydraulic fluid reservoir according to the present disclosure.

It should be understood at the outset that, although two exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

During research and development, the present inventors determined that it is desirable to mount a relatively large power steering reservoir directly to an outboard motor. The inventors determined that it is also preferable to provide such a reservoir with a vented cap, so that the reservoir accommodates expansion and contraction of the hydraulic fluid during changing pressures and temperatures. The inventors further determined that it would be desirable to provide such a reservoir with electronic fluid level sensing to alert the operator and protect the components in case of fluid loss. The present disclosure is a result of these efforts.

FIG. 1 depicts an outboard motor 20 and related components for propelling a marine vessel 22 in water. The outboard motor 20 extends in a vertical direction V, in a longitudinal direction L that is perpendicular to the vertical direction V, and in a transverse direction T (see FIG. 2) that is perpendicular to the vertical direction V and perpendicular to the longitudinal direction L. The outboard motor 20 is connected to the transom 23 of the marine vessel 22 by a transom bracket 24. The outboard motor 20 has an engine 26, which causes rotation of a driveshaft 29. The driveshaft 29 is coupled to a propeller 28 via a transmission 30 and propeller shaft 32 located in the lower gearcase 34 of the outboard motor 20. Rotation of the driveshaft 29 causes rotation of the propeller shaft 32, which in turn causes rotation of the propeller 28. Rotation of the propeller 28 causes the propeller blades 37 to impart a thrust force that propels the marine vessel 22. A trim actuator 36 is coupled to the outboard motor 20 and the transom bracket 24 and is configured to trim the outboard motor 20 about a horizontal trim axis 38 in a known manner, for example as described in the above-incorporated U.S. Pat. No. 9,944,385. The type and configuration of the transom bracket 24 and trim actuator 36 can vary from what is shown. In the illustrated example, the trim actuator 36 comprises a hydraulic cylinder having a piston that extends from and retracts into the cylinder to thereby trim the outboard motor 20. Extension of the trim actuator 36 trims the outboard motor 20 into a raised position in which the outboard motor 20 is trimmed up out of the water. Retraction of the trim actuator 36 trims the outboard motor 20 into a lowered position in which the outboard motor 20 is fully trimmed down into the water and in some instances tucked with respect to the transom 23, as further explained herein below.

A hydraulic steering actuator 40 is coupled to the outboard motor 20 and configured to cause steering movements of the outboard motor 20 about a steering axis 42. The type and configuration of the hydraulic steering actuator 40 can vary, and for example can be any one of the examples disclosed in the above-incorporated U.S. patents.

Figure 2:
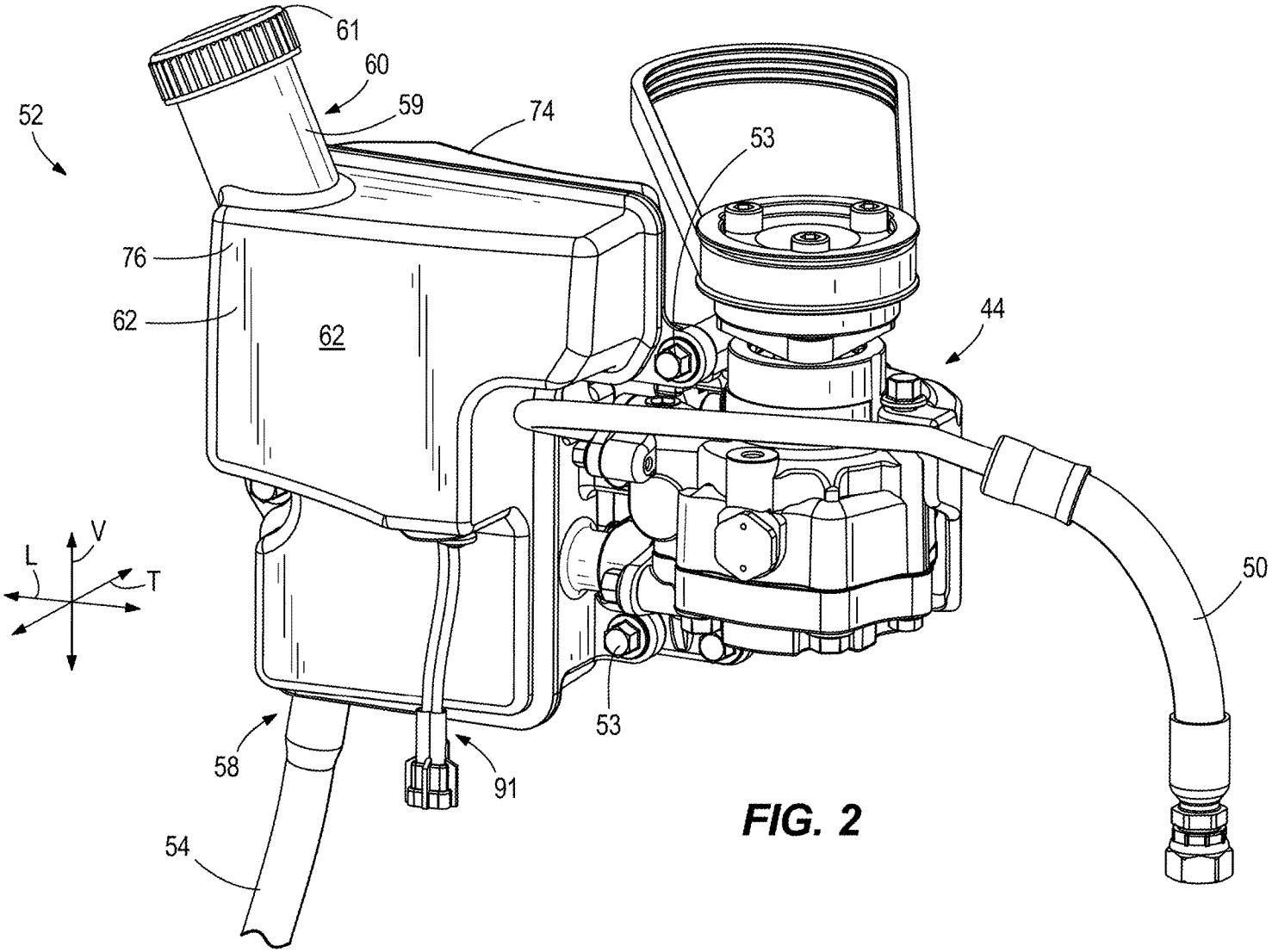
FIG. 2 is a perspective side view of the reservoir and a hydraulic pump for pumping fluid from the reservoir to a steering actuator for the outboard motor.

Referring to FIGS. 1 and 2, a pump 44 is configured to pump hydraulic fluid to the steering actuator 40. The pump 44 is mounted to the outboard motor 20 within an engine compartment 46 that is accessible by removal of a top cowl 48. Optionally, as shown in the illustrated example, the pump 44 is located higher than the steering actuator 40 with respect to the vertical direction V, thus promoting acceptable relative fluid pressures and pumping efficiency. A supply line 50 connects the pump 44 to the steering actuator 40. Operation of the pump 44 forces hydraulic fluid through the supply line 50 to the steering actuator 40.

Figure 17:
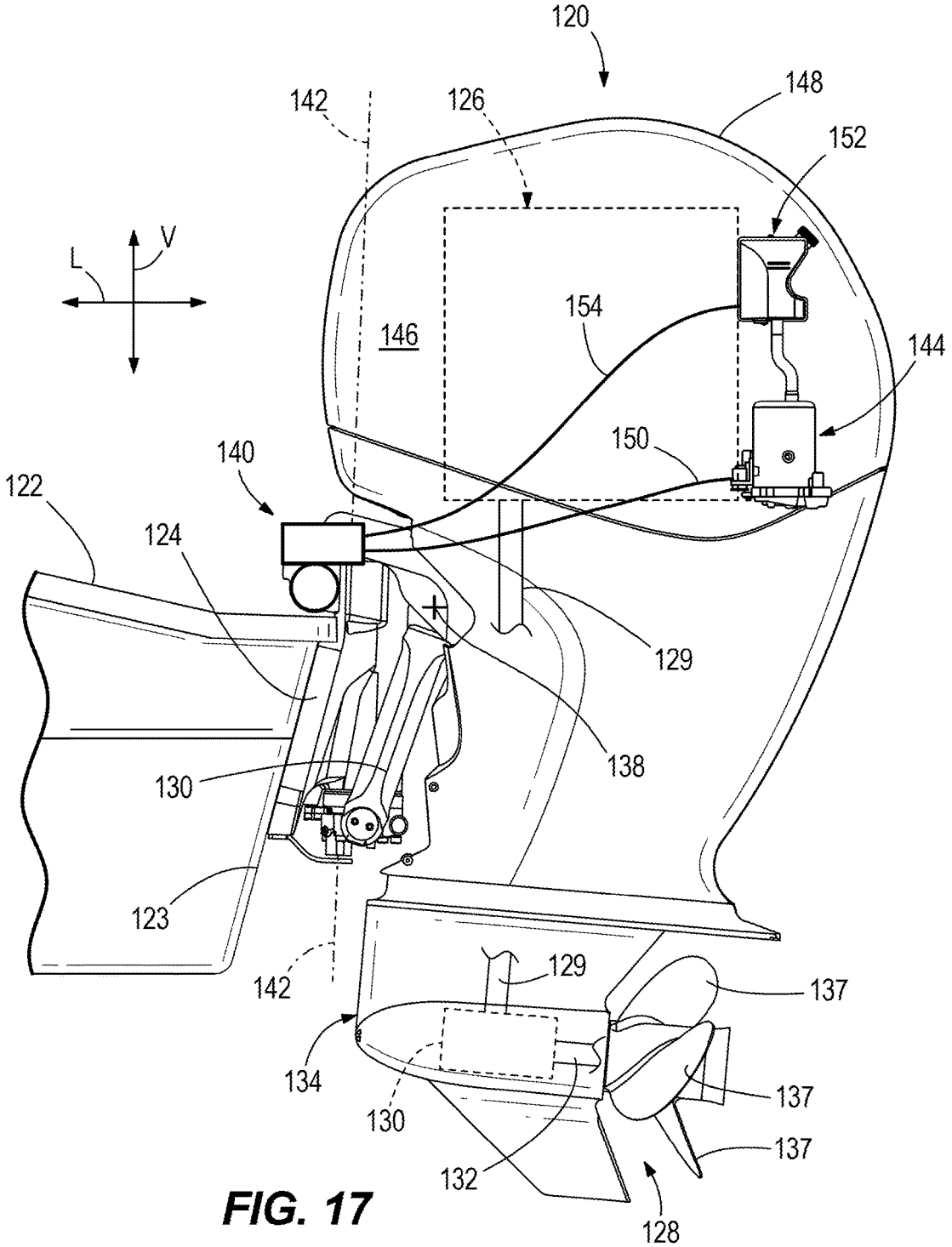
FIG. 17 is a side view of a marine vessel and an outboard motor having a second example of a hydraulic fluid reservoir according to the present disclosure.

A first example of a reservoir 52 according to the present disclosure is mounted on the outboard motor 20, and is more particularly coupled to the pump 44. Optionally, as shown in the illustrated example, the reservoir 52 is located such that the hydraulic fluid is higher than the pump inlet with respect to the vertical direction V, thus promoting acceptable relative fluid pressures and pumping efficiency. The type of mounting connection can vary from what is shown. Another example is shown in FIG. 17, which is further described herein below. In the example shown in FIG. 1, the reservoir 52 is fastened to the pump 44 by fasteners 53. The reservoir 52 contains hydraulic fluid for the steering actuator 40. In particular, the pump 44 is configured to pump the hydraulic fluid from the reservoir 52 to the steering actuator 40 via the supply line 50. The hydraulic fluid is returned from the steering actuator 40 to the reservoir 52 via a return line 54. The reservoir 52 is a principle subject of the present disclosure and is further described herein below.

Referring to FIGS. 3-12, the reservoir 52 has a reservoir outlet 56 via which the hydraulic fluid is supplied to the steering actuator 40 via the pump 44 and supply line 50. Optionally, as shown in FIG. 2, the reservoir outlet 56 can be directly coupled to the pump 44 without an additional line. The reservoir 52 further has a reservoir inlet 58 via which the hydraulic fluid is returned to the reservoir 52 from the steering actuator 40. Optionally, a screen or filter (not shown) can be installed on the reservoir outlet 56 and/or reservoir inlet 58 for filtering the hydraulic fluid. The reservoir 52 further has a vent opening 60 that vents the reservoir 52 to atmosphere. The vent opening 60 has a fill neck 59 and a screw-on, vented cap 61. Optionally, a screen or filter (not shown) can be located on the fill neck 59 for filtering the hydraulic fluid as it is added to the reservoir 52. The type and configuration of cap 61 can vary from what is shown, including examples available from Mercury Marine Part No. 8M6005909 and 8M0135340. Other industry examples are available from Northern Tool Model No. HBF16. As explained further herein below, the vent opening 60 is located and configured such that it does not become covered by hydraulic fluid when the outboard motor 20 is trimmed into and out of the raised and lowered positions, including for storage.

Figure 10:
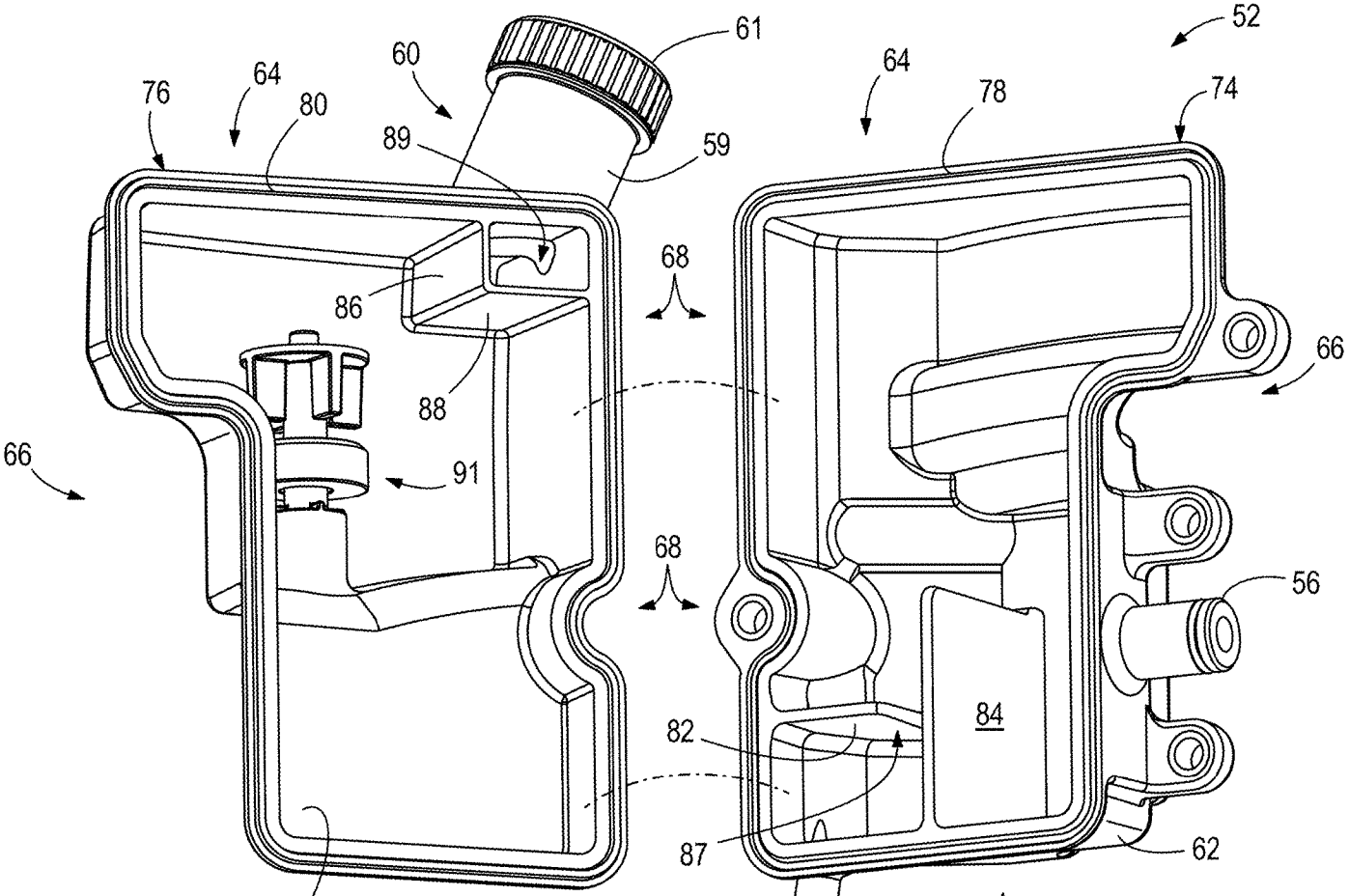
FIG. 10 is an exploded view showing separated port and starboard clamshell portions of the reservoir.
Figure 11:
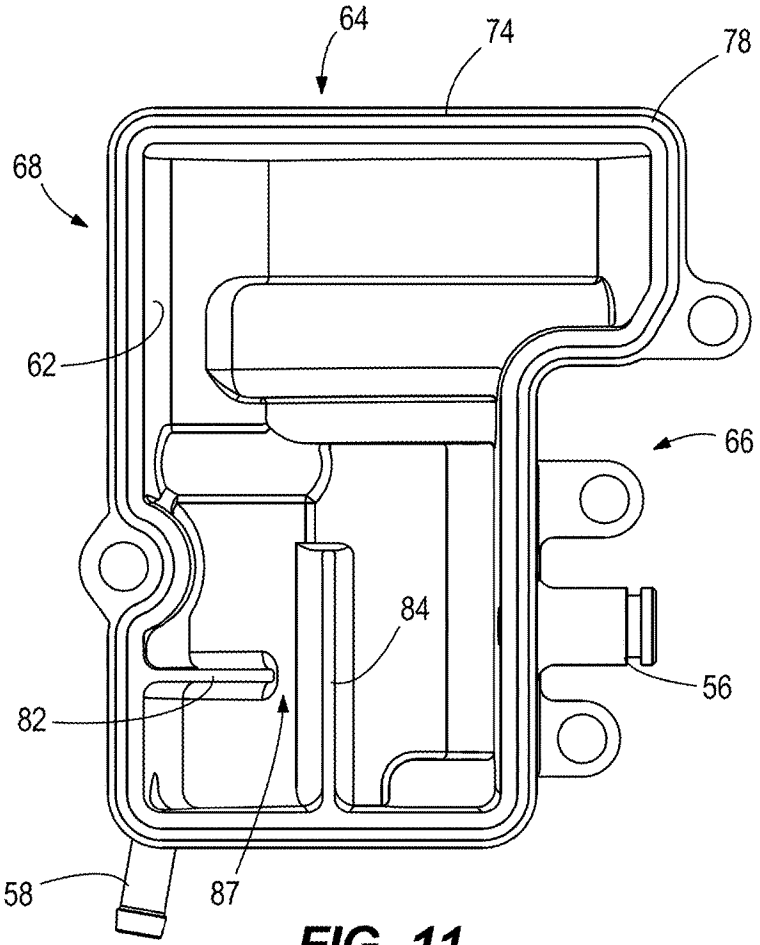
FIG. 11 is a view of the inside of the port clamshell portion.

In the illustrated example, the reservoir 52 is constructed of a plastic housing 62 that extends from top 64 to bottom 65 in the vertical direction V, from front 66 to back 68 in the longitudinal direction L, and from port side 70 to starboard side 72 in the transverse direction T. The housing 62 is a clamshell housing having a first, port clamshell portion 74 and a second, starboard clamshell portion 76, each having a perimeter 78, 80 along which the respective portions 74, 76 are coupled together. In this example, the reservoir outlet 56 and reservoir inlet 58 both extend through the port clamshell portion 74 and not through the starboard clamshell portion 76. Referring to FIGS. 10 and 11, flow separation baffles 82, 84 extend into the port clamshell portion 74 and are specially configured to divert hydraulic fluid from the reservoir inlet 58 away from the reservoir outlet 56. In the illustrated example, the reservoir inlet 58 is located at the bottom 65 of the reservoir 52. The flow separation baffle 82 extends longitudinally inwardly from the back 68 of the housing 62 and the flow separation baffle 84 extends vertically up from the bottom 65 of the housing 62 transverse to and past the flow separation baffle 82, so as to define a space 87 for the hydraulic fluid to flow further into the housing 62 from the reservoir inlet 58. The reservoir outlet 56 is located at the front 66 of the reservoir 52. Thus the flow separation baffles 82, 84 divert the hydraulic fluid entering from the reservoir inlet 58 generally away from the reservoir outlet 56, thus preventing short circuiting of fluid through the housing 62, in other words preventing the returning hydraulic fluid from going directly from the reservoir inlet 58 to the pump 44 via the reservoir outlet 56. The flow separation baffles 82, 84 further have been found to advantageously reduce fluid turbulence to reduce air bubbles in the hydraulic fluid, thus improving efficiency of the pump 44. The flow separation baffles 82, 84 also have been found to reduce back pressure on the return fluid and promote better flow through and pressure in the housing 62. The flow separation baffles 82, 84 are only located on one side of the housing 62, i.e., on the same side of the housing 62 as the reservoir outlet 56 and reservoir inlet 58, thus enabling free flow of hydraulic fluid on the opposite side of the housing 62.

Figure 12:
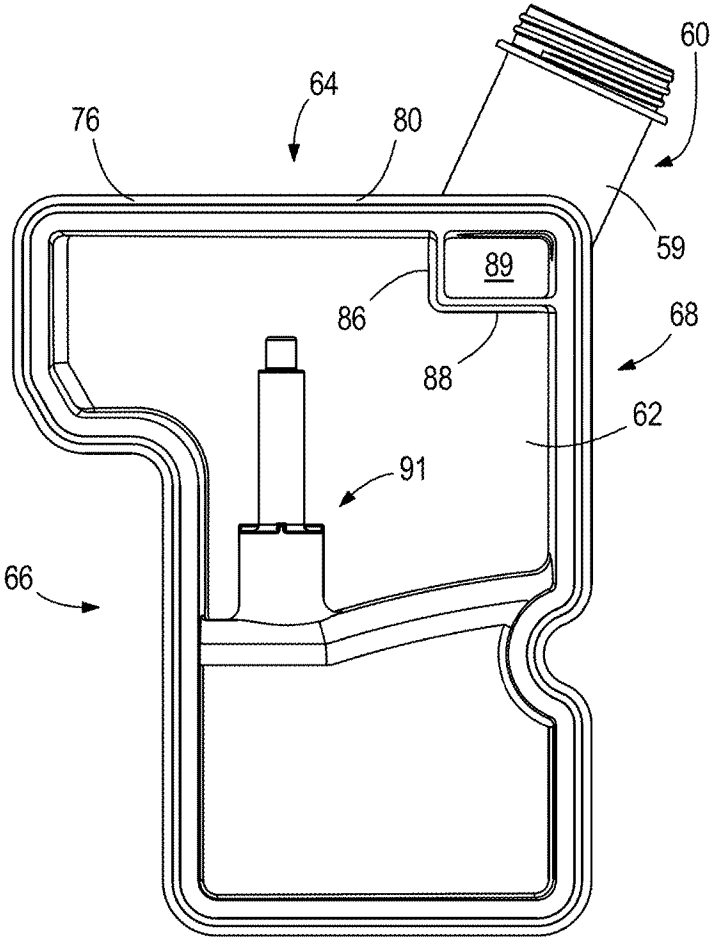
FIG. 12 is a view of the inside of the starboard clamshell portion.

The vent opening 60 is located on the corner of the reservoir 52, closer to the back 68 of the reservoir 52 and the back of the outboard motor 20 than the front 66 of the reservoir 52 and outboard motor 20. The vent opening 60 extends through the top 64 of the starboard clamshell portion 76 but not through the port clamshell portion 74. Referring to FIGS. 10 and 12, splash baffles 86, 88 extend into the reservoir 52 only in the starboard clamshell portion 76. The splash baffles 86, 88 are configured to divert splashes of the hydraulic fluid away from the vent opening 60 when the reservoir 52 is agitated, for example during movement of the outboard motor 20 and/or marine vessel 22. The splash baffle 86 extends downwardly from the top 64 of the housing 62 and the splash baffle 88 extends longitudinally inwardly from the back 68 of the housing 62 to the splash baffle 86. The splash baffles 86, 88 are thus joined together and define a compartment 89 in the starboard clamshell portion 76 that prevents hydraulic fluid from contacting the cap 61 and therefore help prevent leakage. The splash baffles 86, 88 do not extend into the port clamshell portion 74 and thus are also configured to allow fluid to freely enter the middle of the reservoir during filling via the adjacent port clamshell portion 74.

Figure 4:
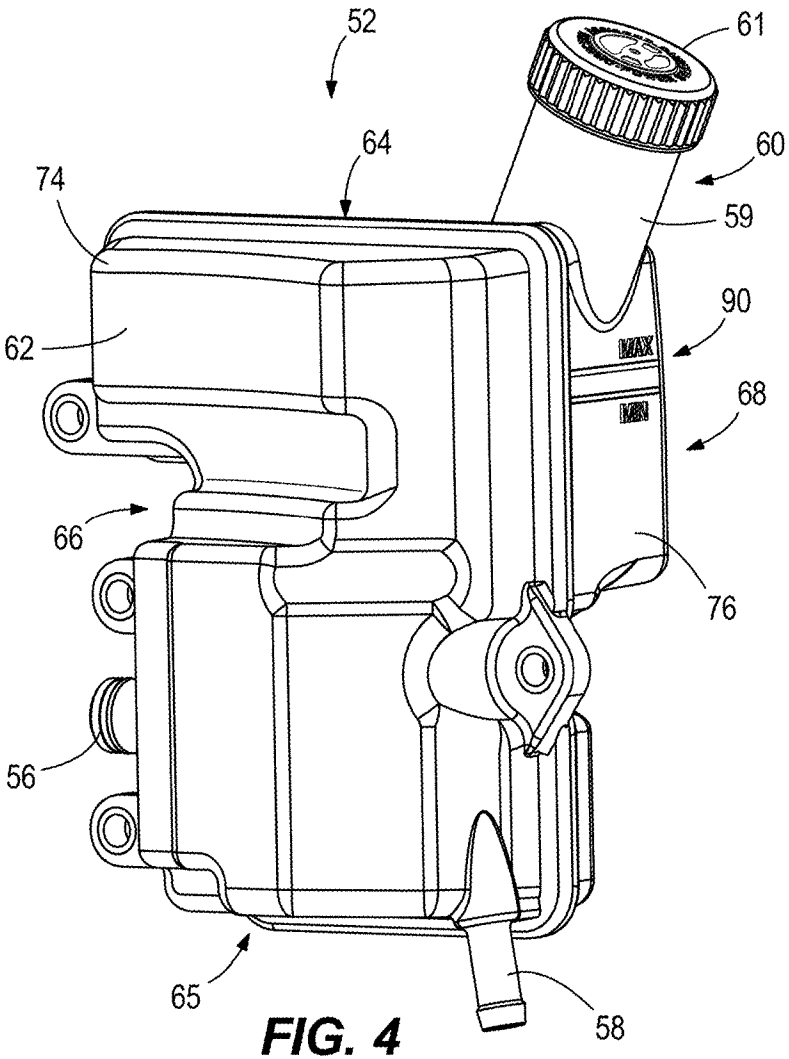
FIG. 4 is a perspective view of the port side of the reservoir.
Figure 3:
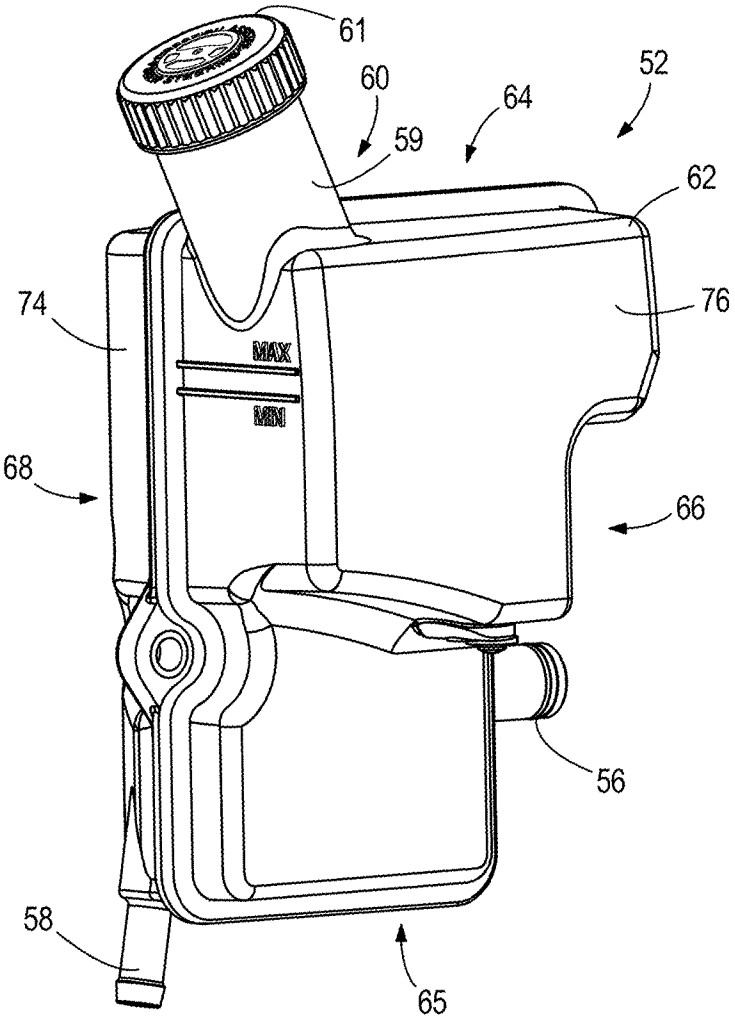
FIG. 3 is a perspective view of the starboard side of the reservoir.
Figure 6:
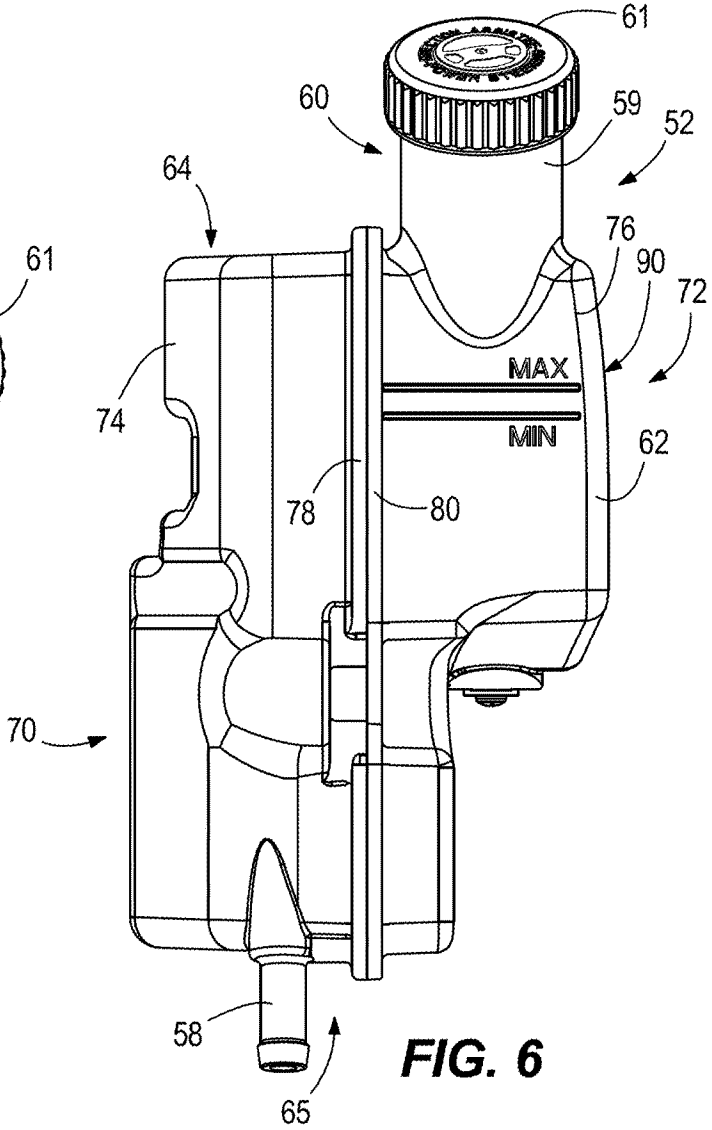
FIG. 6 is a rear view of the reservoir.
Figure 5:
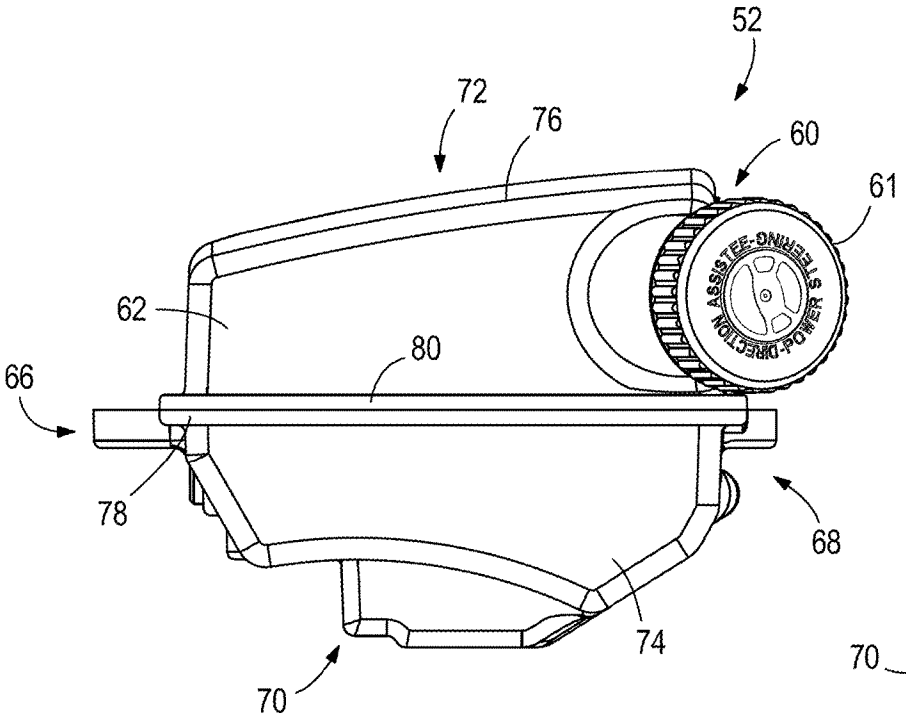
FIG. 5 is a top view of the reservoir.
Figure 7:
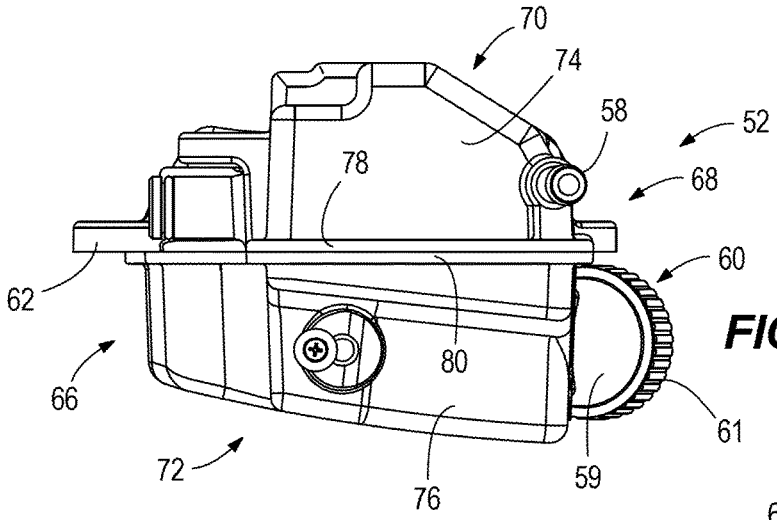
FIG. 7 is a bottom view of the reservoir.
Figure 8:
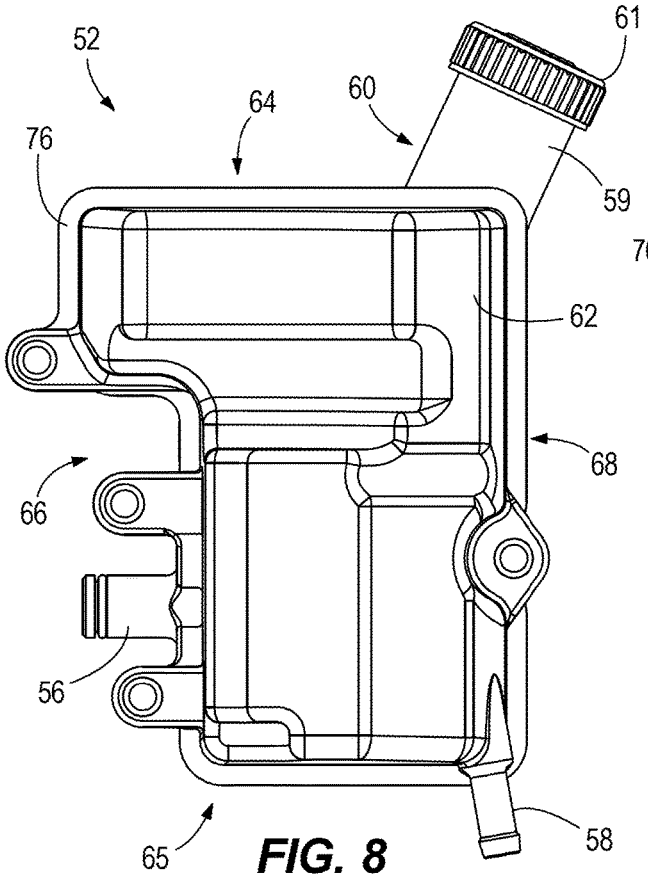
FIG. 8 is a port side view of the reservoir.
Figure 9:
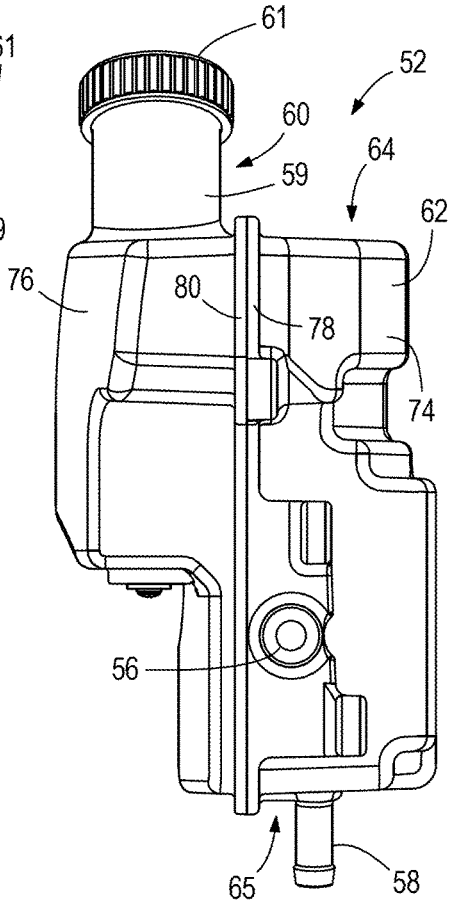
FIG. 9 is a front view of the reservoir.

Referring to FIGS. 4 and 6, a vertical fill line 90 is located on the reservoir 52 and designates minimum and maximum fill levels for the hydraulic fluid. The housing 62 can be made of a transparent material to assist viewing of the level of hydraulic fluid inside the reservoir 52. The vertical fill line 90 and vent opening 60 are positioned relative to each other so that the vent opening 60 does not become covered by the hydraulic fluid when the outboard motor 20 is trimmed into and out of the raised and lowered position. Referring to FIGS. 10 and 12, an electronic fluid level sensor 91 is located inside of the housing 62 and extends vertically upwardly to the vertical fill line 90. The electronic fluid level sensor 91 is configured to sense the level of the hydraulic fluid and communicate the sensed level to, for example, a controller associated with the outboard motor 20 and/or marine vessel 22. The type and configuration of electronic fluid level sensor can vary from what is shown. Suitable examples are available from Mercury Marine, part number 8M0096778. Other industry examples include a fluid level sensing reed switch from Grainger.

Figure 14:
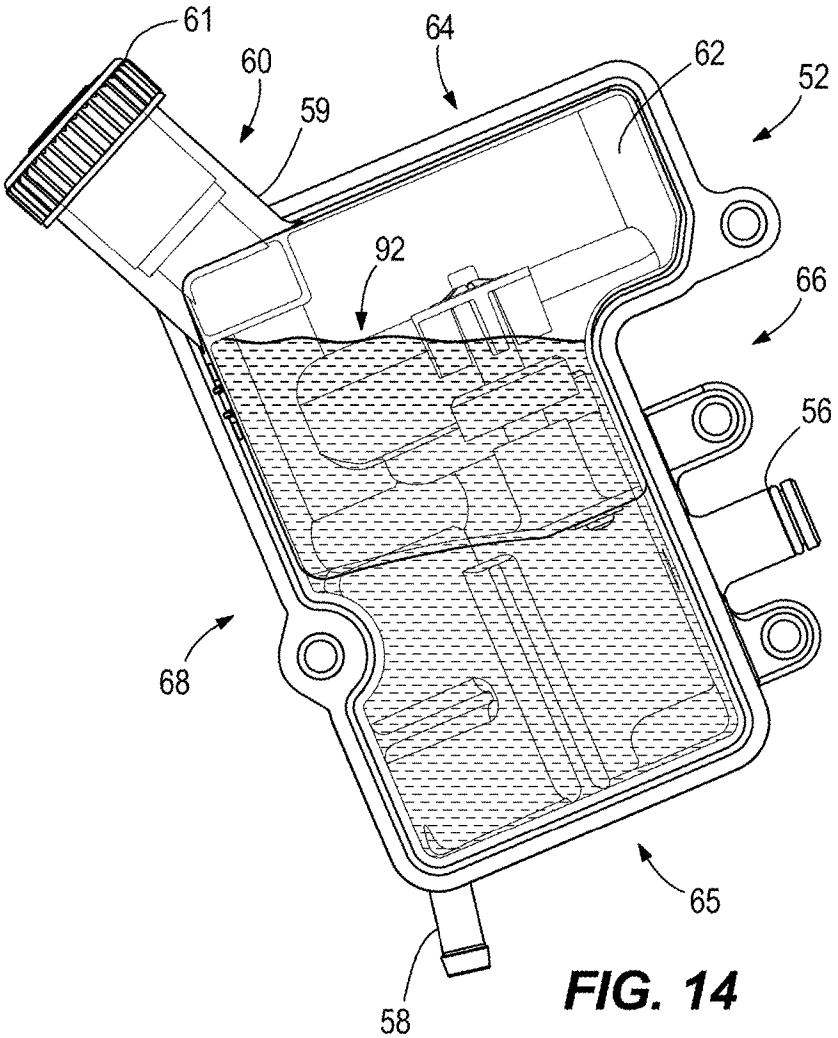
FIGS. 13-16 are sectional views of the reservoir at various trim angles.
Figure 13:
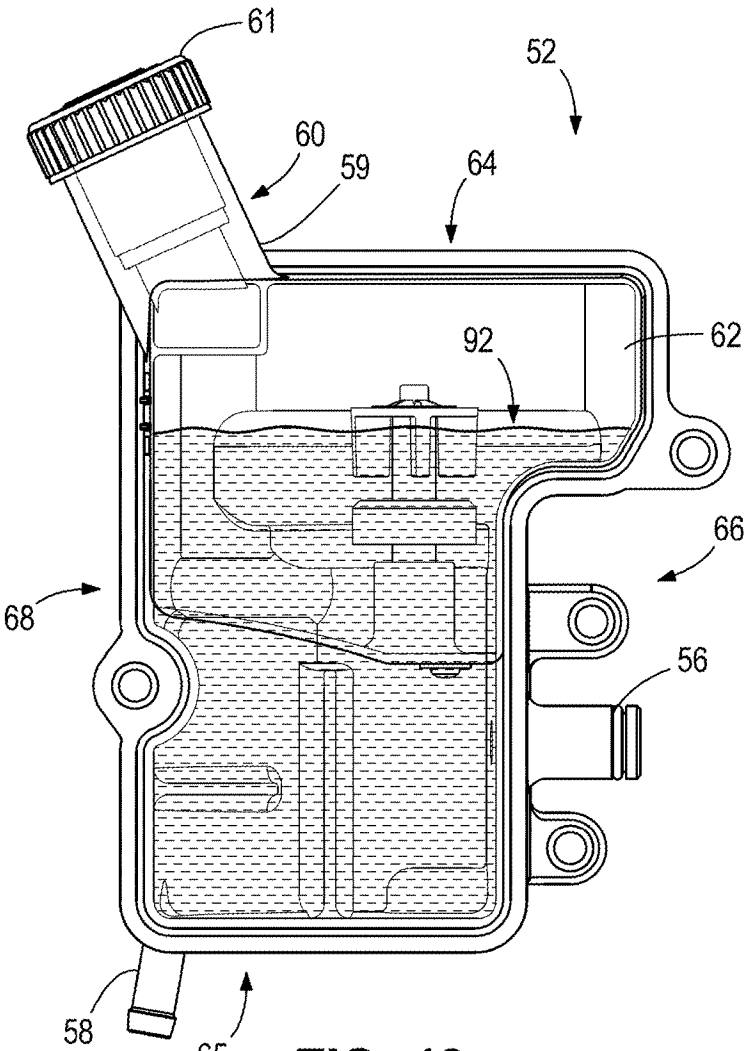
Figure 16:
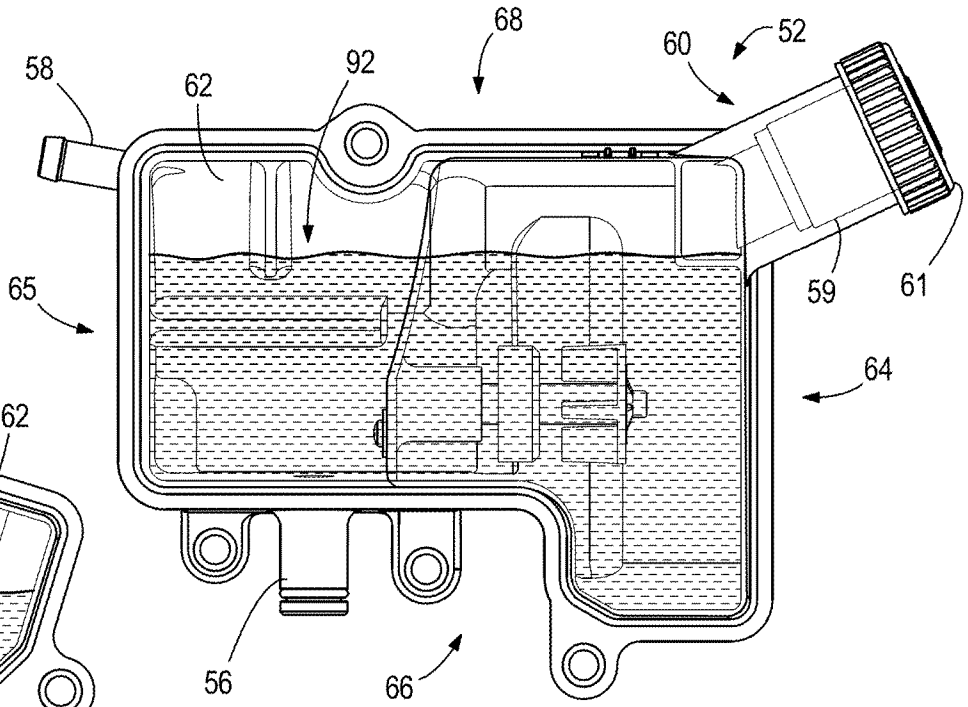
Figure 15:
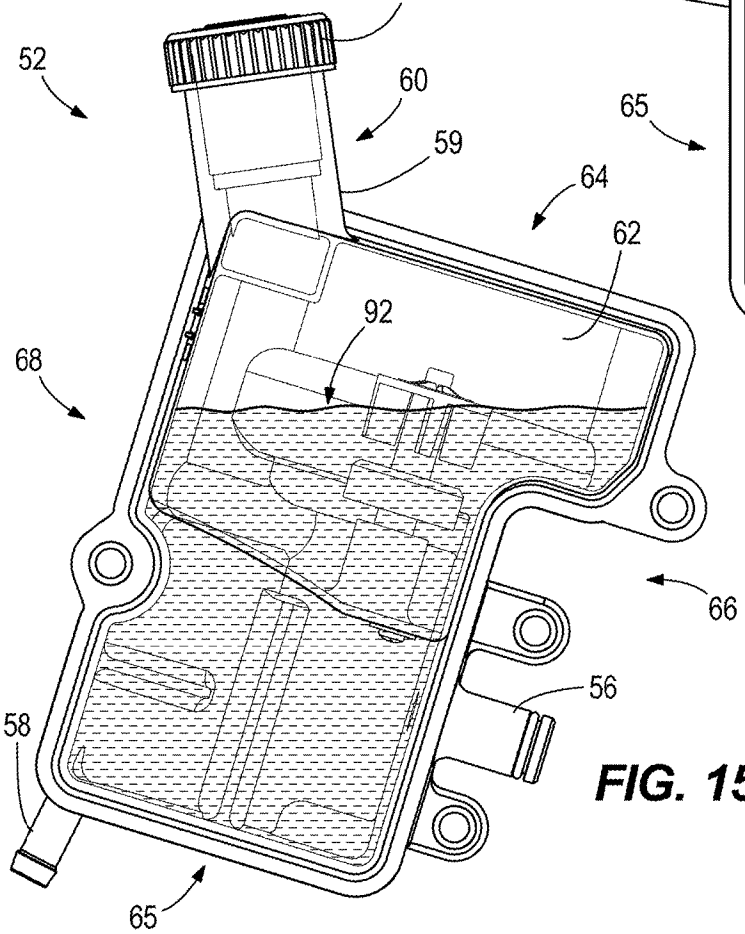
Figure 19:
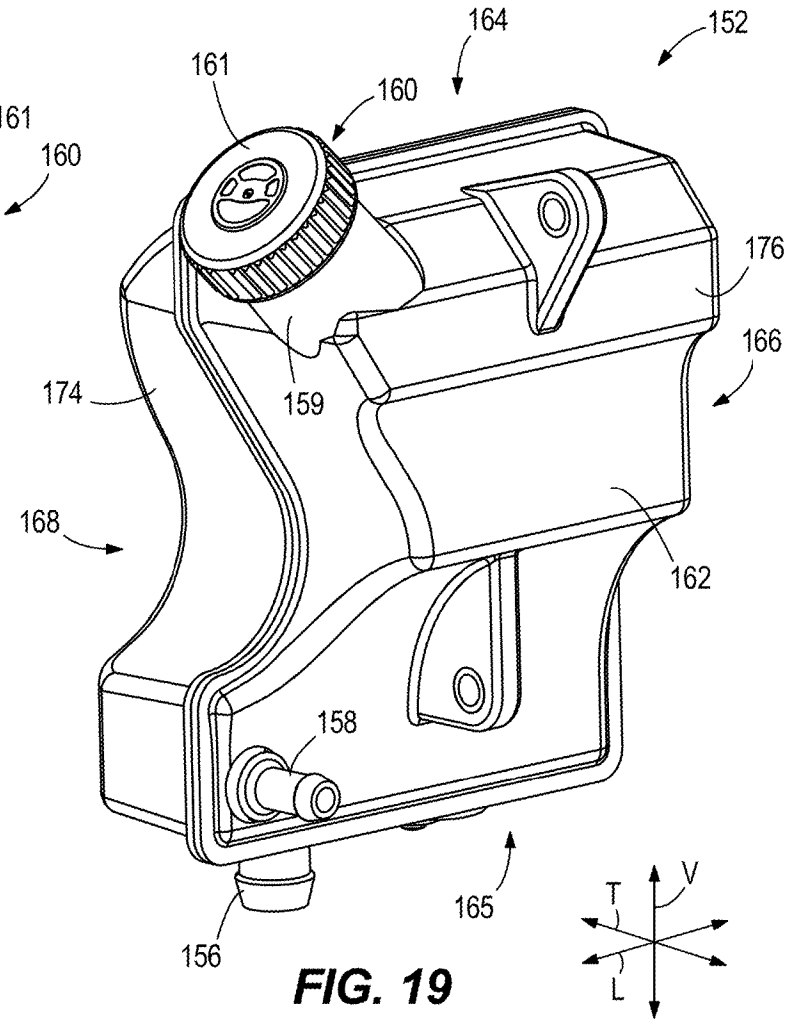
FIG. 19 is a perspective view of the starboard side of the reservoir.
Figure 18:
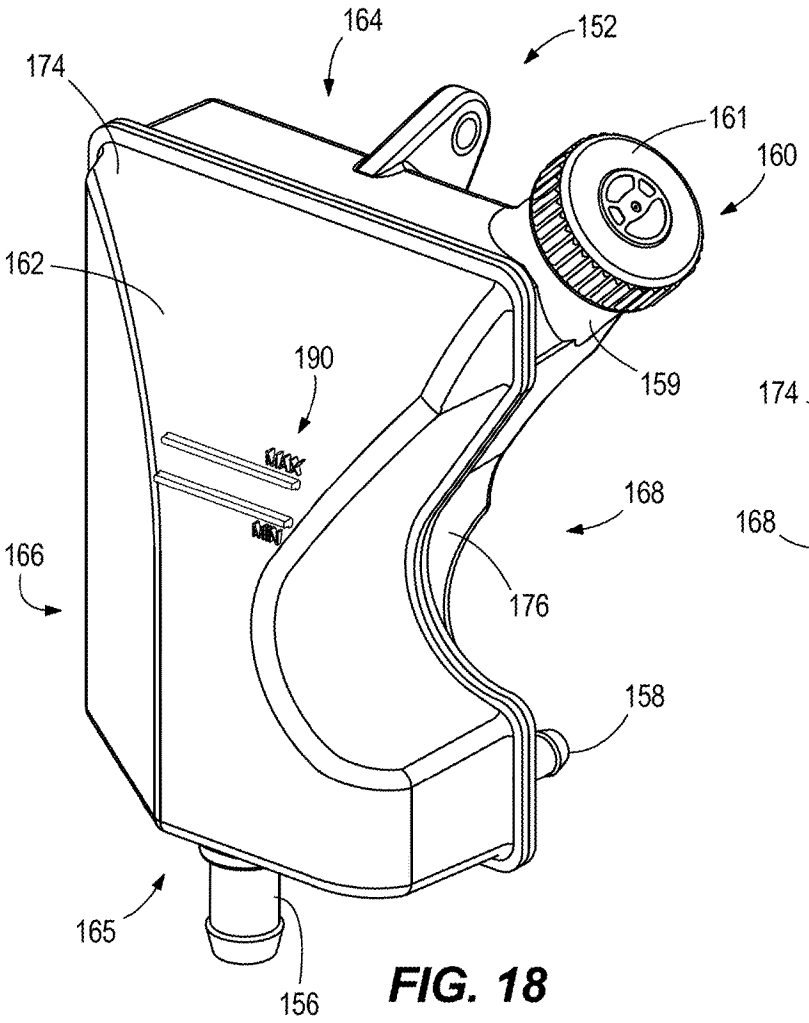
FIG. 18 is a perspective view of the port side of the reservoir.
Figure 21:
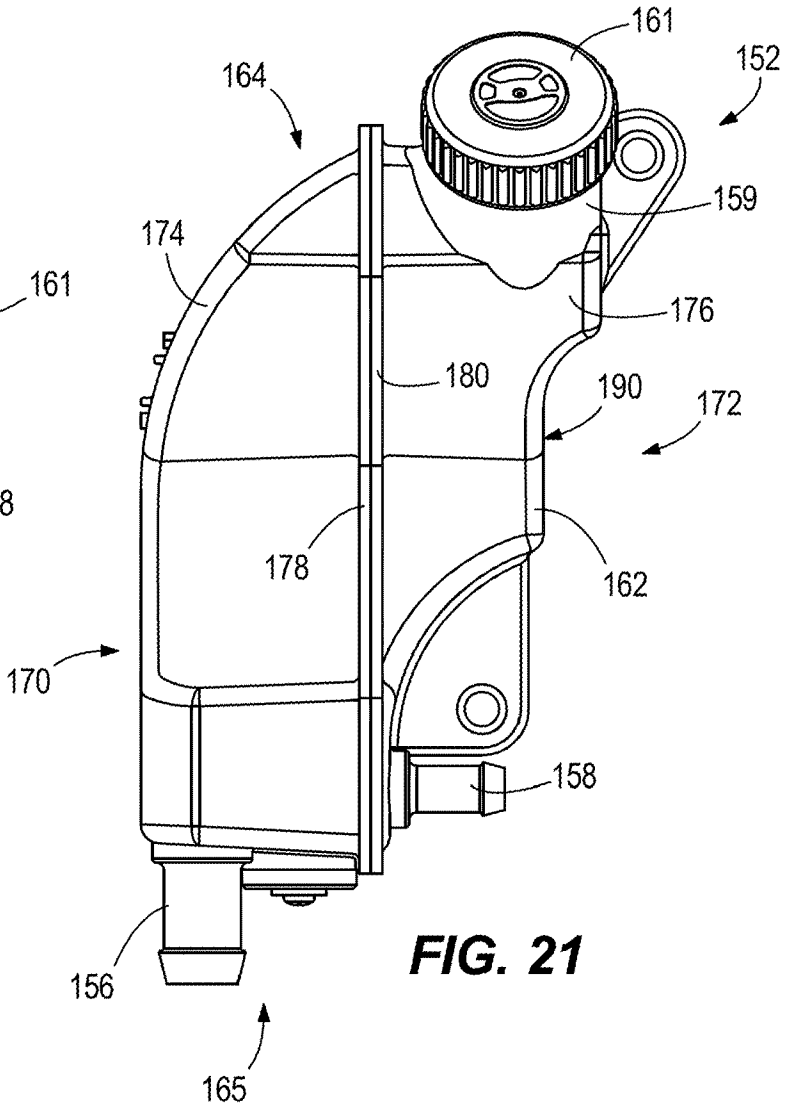
FIG. 21 is a rear view of the reservoir.
Figure 20:
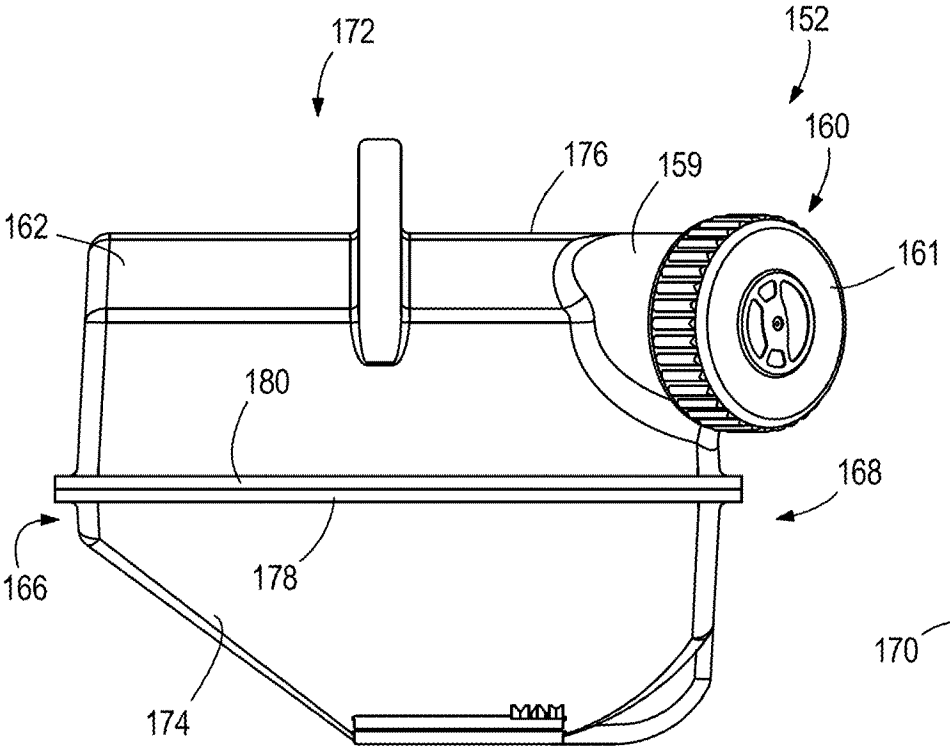
FIG. 20 is a top view of the reservoir.
Figure 23:
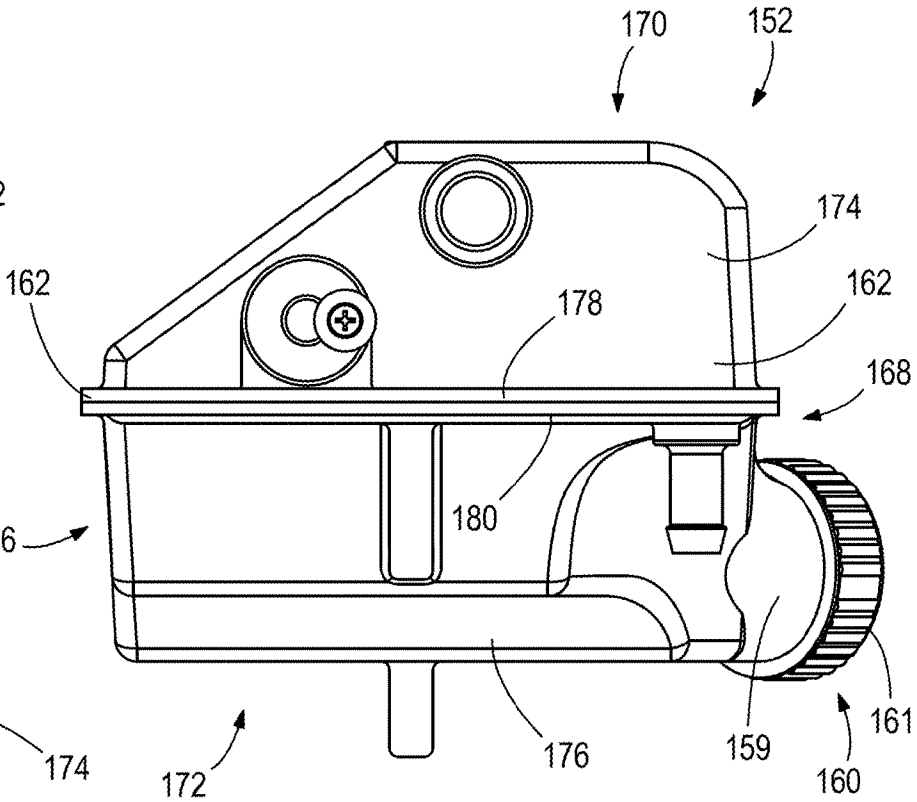
FIG. 23 is a bottom view of the reservoir.
Figure 22:
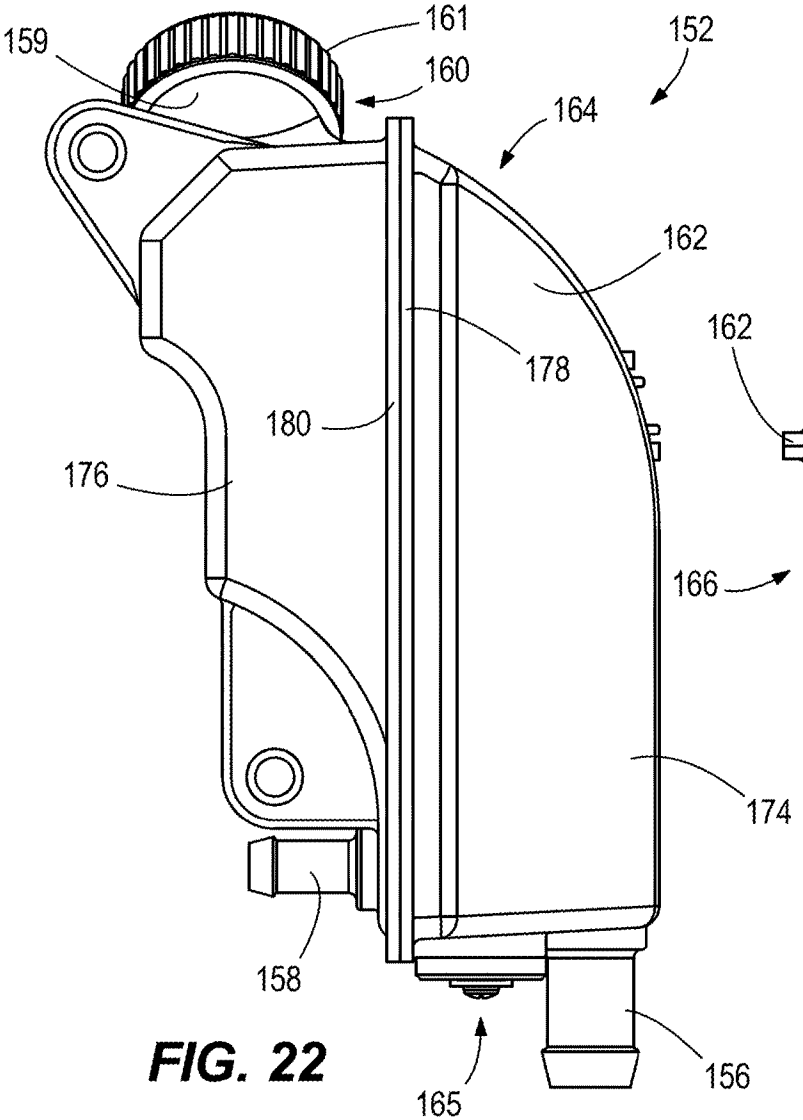
FIG. 22 is a front view of the reservoir.
Figure 25:
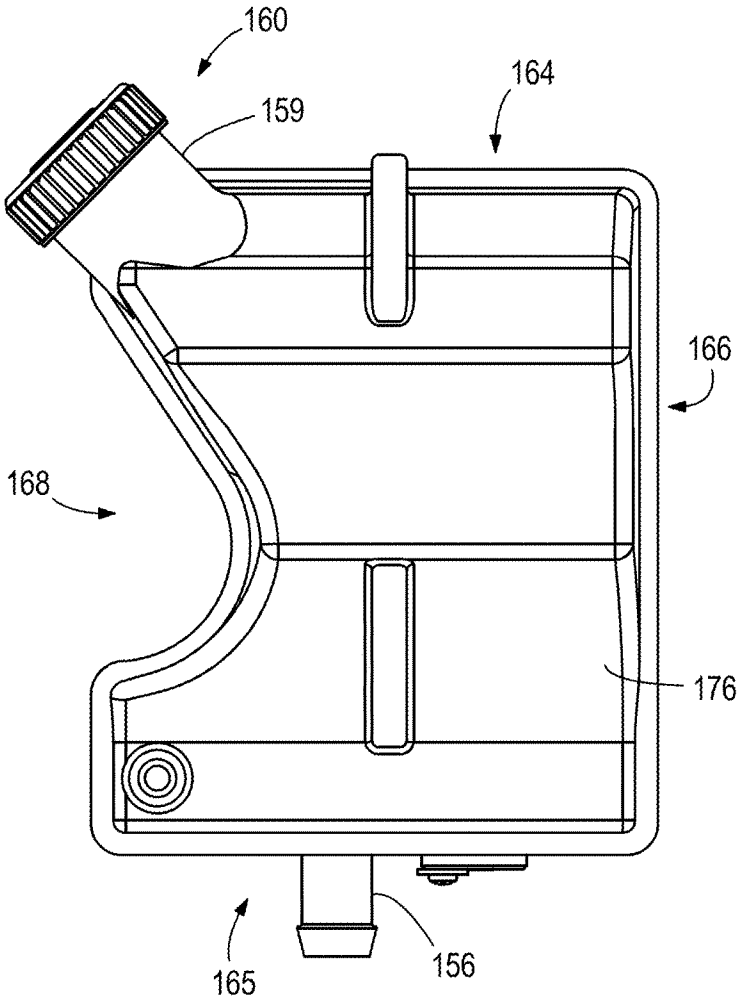
FIG. 25 is a view of the starboard side of the reservoir.

Referring to FIGS. 13-16, the reservoir 52 is specially configured so that top surface 92 of the hydraulic fluid in in the housing 62 does not cover the vent opening 60 during the various operational positions of the outboard motor 20. FIG. 13 depicts the reservoir 52 while the outboard motor 20 is in a level position, such as shown in FIG. 1. The hydraulic fluid in the reservoir settles by gravity such that the top surface 92 is generally horizontal and located vertically below the vent opening 60. FIG. 14 depicts the reservoir 52 while the outboard motor 20 is in a tucked position (i.e. a trimmed down position in which the outboard motor 20 is tucked twenty-three degrees from vertical orientation). The hydraulic fluid in the reservoir settles by gravity such that the top surface 92 remains generally horizontal and is still vertically below the vent opening 60. FIG. 15 depicts the reservoir 52 while the outboard motor 20 is in a trimmed up position (i.e., a trimmed up position in which the outboard motor is trimmed up seventeen degrees from vertical orientation). The hydraulic fluid settles by gravity such that the top surface 92 remains below the vent opening 60. Finally, FIG. 16 depicts the reservoir 52 when the outboard motor 20 is placed in a storage position in which the outboard motor 20 is laid down on its forward side. As shown, the hydraulic fluid settles by gravity such that the top surface 92 remains below the vent opening 60. FIG. 17 depicts another example of an outboard motor 120 and related components for propelling a marine vessel 122 in water. Similar to the first example described herein above, the outboard motor 120 extends in a vertical direction V, in a longitudinal direction L that is perpendicular to the vertical direction V, and in a transverse direction T (see FIG. 19) that is perpendicular to the vertical direction V and perpendicular to the longitudinal direction L. The outboard motor 120 is connected to the transom 123 of the marine vessel 122 by a transom bracket 124. The outboard motor 120 has an engine 126, which causes rotation of a driveshaft 129. The driveshaft 129 is coupled to a propeller 128 via a transmission 130 and propeller shaft 132 located in the lower gearcase 134 of the outboard motor 120. Rotation of the driveshaft 129 causes rotation of the propeller shaft 132, which in turn causes rotation of the propeller 128. Rotation of the propeller 128 causes the propeller blades 137 to impart a thrust force that propels the marine vessel 122. A trim actuator 136 is coupled to the outboard motor 120 and the transom bracket 124 and is configured to trim the outboard motor 120 about a horizontal trim axis 138 in a known manner, for example as described in the above-incorporated U.S. Pat. No. 9,944,385. The type and configuration of the transom bracket 124 and trim actuator 136 can vary from what is shown. In the illustrated example, the trim actuator 136 comprises a hydraulic cylinder having a piston that extends from and retracts into the cylinder to thereby trim the outboard motor 120. Extension of the trim actuator 136 trims the outboard motor 120 into a raised position in which the outboard motor 120 is trimmed up out of the water. Retraction of the trim actuator 136 trims the outboard motor 120 into a lowered position in which the outboard motor 120 is fully trimmed down into the water and in some instances tucked with respect to the transom 123, as further explained herein below.

A hydraulic steering actuator 140 is coupled to the outboard motor 120 and configured to cause steering movements of the outboard motor 120 about a steering axis 142. The type and configuration of the hydraulic steering actuator 140 can vary, and for example can be any one of the examples disclosed in the above-incorporated U.S. patents.

Referring to FIG. 17, a pump 144 is configured to pump hydraulic fluid to the steering actuator 140. The pump 144 is mounted to the outboard motor 120 within an engine compartment 146 that is accessible by removal of a top cowl 148. Unlike the first example described herein above, the pump 144 is located on the aftward side of the engine 126. Optionally, as shown in the illustrated example, the pump 144 is located higher than the steering actuator 140 with respect to the vertical direction V, thus promoting acceptable relative fluid pressures and pumping efficiency. A supply line 150 connects the pump 144 to the steering actuator 140. Operation of the pump 144 forces hydraulic fluid through the supply line 150 to the steering actuator 140. A reservoir 152 is also mounted on the aftward side of the engine 126 of the outboard motor 120, and more particularly above and spaced apart from the pump 144. Optionally, as shown in the illustrated example, the reservoir 52 is located such that the hydraulic fluid is higher than the pump inlet with respect to the vertical direction V, thus promoting acceptable relative fluid pressures and pumping efficiency. The type of mounting connection can vary and can for example include bolts, like disclosed in the first embodiment. The reservoir 152 contains hydraulic fluid for the steering actuator 140. In particular, the pump 144 is configured to pump the hydraulic fluid from the reservoir 152 to the steering actuator 140 via the supply line 150. The hydraulic fluid is returned from the steering actuator 140 to the reservoir 152 via a return line 154.

Referring to FIGS. 18-28, the reservoir 152 has a reservoir outlet 156 via which the hydraulic fluid is supplied to the steering actuator 140 via the pump 144 and supply line 150. The reservoir 152 further has a reservoir inlet 158 via which the hydraulic fluid is returned to the reservoir 152 from the steering actuator 140. Optionally, a screen or filter (not shown) can be installed on the reservoir outlet 156 and/or reservoir inlet 158 for filtering the hydraulic fluid. The reservoir 152 further has a vent opening 160 that vents the reservoir 152 to atmosphere. The vent opening 160 has a fill neck 159 and a screw-on, vented cap 161. Optionally, a screen or filter (not shown) can be located on the fill neck 159 for filtering the hydraulic fluid as it is added to the reservoir 152. The type and configuration of cap 161 can vary from what is shown, including examples available from Mercury Marine Part No. 8M6005909 and 8M0135340. Other industry examples are available from Northern Tool Model No. HBF16. Similar to the first embodiment, the vent opening 160 is located and configured such that it does not become covered by hydraulic fluid when the outboard motor 120 is trimmed into and out of the raised and lowered positions, including for storage.

In the illustrated example, the reservoir 152 is constructed of a plastic housing 162 that extends from top 164 to bottom 165 in the vertical direction V, from front 166 to back 168 in the longitudinal direction L, and from port side 170 to starboard side 172 in the transverse direction T. The housing 162 is a clamshell housing having a first, port clamshell portion 174 and a second, starboard clamshell portion 176, each having a perimeter 178, 180 along which the respective portions 174, 176 are coupled together. The reservoir outlet 156 extends through the port clamshell portion 174 and not through the starboard clamshell portion 176. The reservoir inlet 158 extends through the starboard clamshell portion 176 and not through the port clamshell portion 174.

Figure 26:
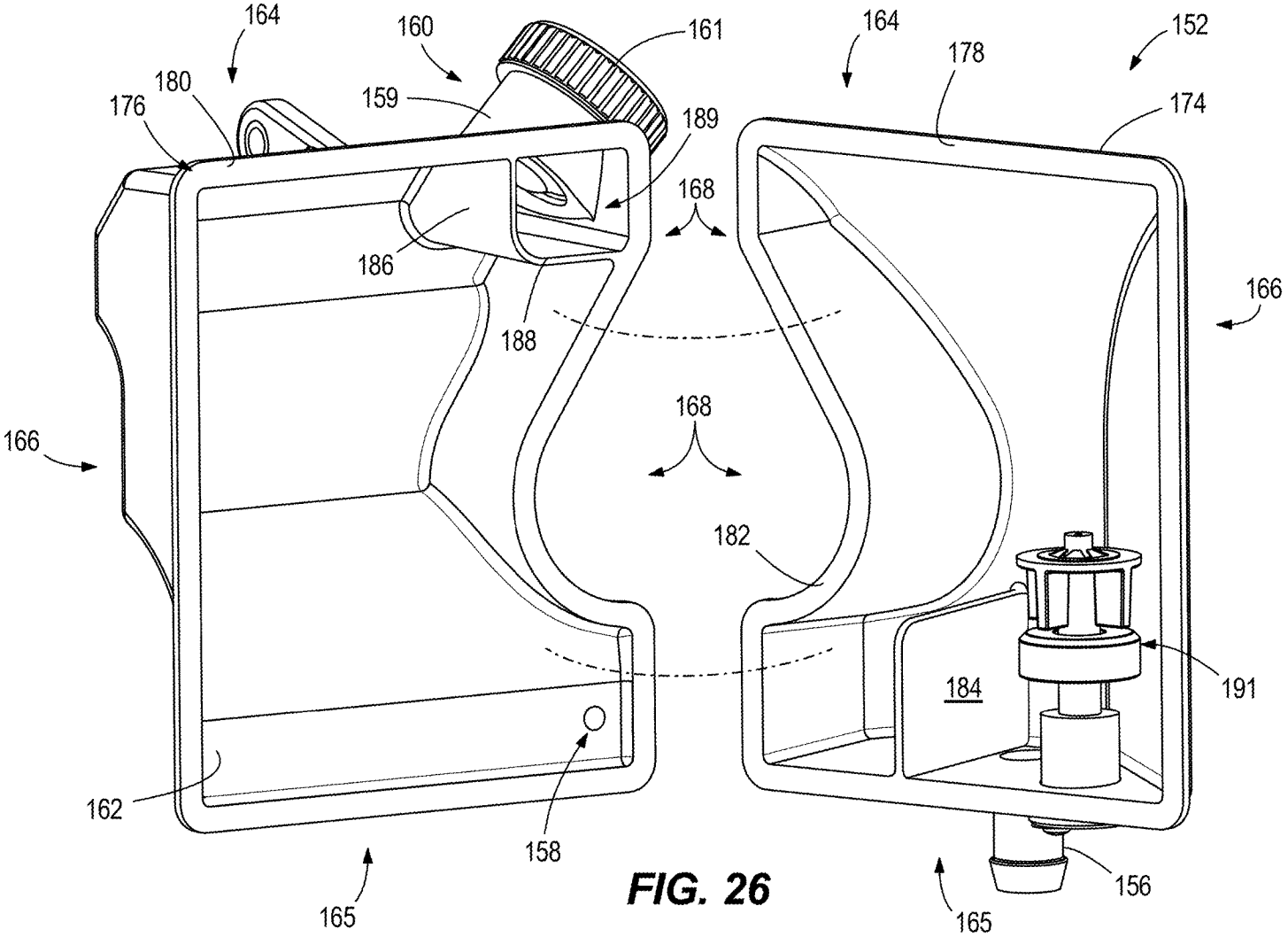
FIG. 26 is an exploded view showing separated port and starboard clamshell portions of the reservoir.

Referring to FIG. 26, a flow separation baffle 184 extends into the port clamshell portion 174 and is specially configured to divert hydraulic fluid from the reservoir inlet 158 away from the reservoir outlet 156. In the illustrated example, the reservoir inlet 158 is located near the bottom 165 of the reservoir 152. The flow separation baffle 184 extends vertically up from the bottom 165 of the housing 162 so as to define a space for the hydraulic fluid to flow further into the housing 162 from the reservoir inlet 158. The reservoir outlet 156 is located at the bottom 165 of the port clamshell portion 174, on the opposite side of the reservoir 152 relative to the reservoir inlet 158. The flow separation baffle 184 diverts the hydraulic fluid entering from the reservoir inlet 158 generally away from the reservoir outlet 156, thus preventing short circuiting of fluid through the housing 162, in other words preventing the returning hydraulic fluid from going directly from the reservoir inlet 158 to the pump 144 via the reservoir outlet 156. The flow separation baffle 184 further has been found to advantageously reduce fluid turbulence to reduce air bubbles in the hydraulic fluid, thus improving efficiency of the pump 144. The flow separation baffle 184 also has been found to reduce back pressure on the return fluid and promote better flow through and pressure in the housing 162. The flow separation baffle 184 is only located on one side of the housing 162, i.e., on the same side of the housing 162 as the reservoir outlet 156, thus enabling free flow of hydraulic fluid on the opposite side of the housing 162.

The vent opening 160 is located on the corner of the reservoir 152, closer to the back 168 of the reservoir 152 and the back of the outboard motor 120 than the front 166 of the reservoir 152 and outboard motor 120. The vent opening 160 extends through the top of the starboard clamshell portion 176 but not through the port clamshell portion 174. Referring to FIG. 26, splash baffles 186, 188 extend into the reservoir 152 only on the starboard clamshell portion 176. The splash baffles 186, 188 are configured to divert splashes of the hydraulic fluid away from the vent opening 160 when the reservoir 152 is agitated, for example during movement of the outboard motor 120 and/or marine vessel 122. The splash baffle 186 extends downwardly from the top 164 of the housing 162 and the splash baffle 188 extends longitudinally inwardly from the back 168 of the housing 162 to the splash baffle 186. The splash baffles 186, 188 are joined together and define a compartment 189 in the starboard clamshell portion 176 that prevents hydraulic fluid from contacting the cap 161 and therefore help prevent leakage. The splash baffles 186, 188 do not extend into the port clamshell portion 174 and thus are also configured to allow fluid to freely enter the middle of the reservoir during filling via the adjacent port clamshell portion 174.

Figure 24:
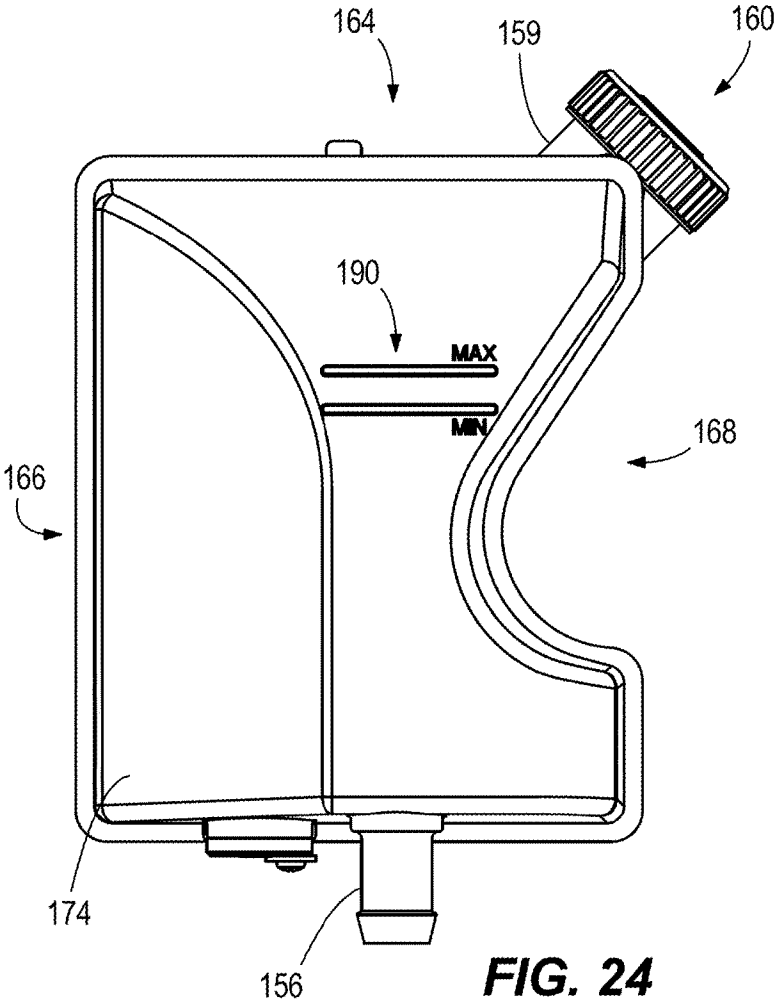
FIG. 24 is a view of the port side of the reservoir.
Figure 28:
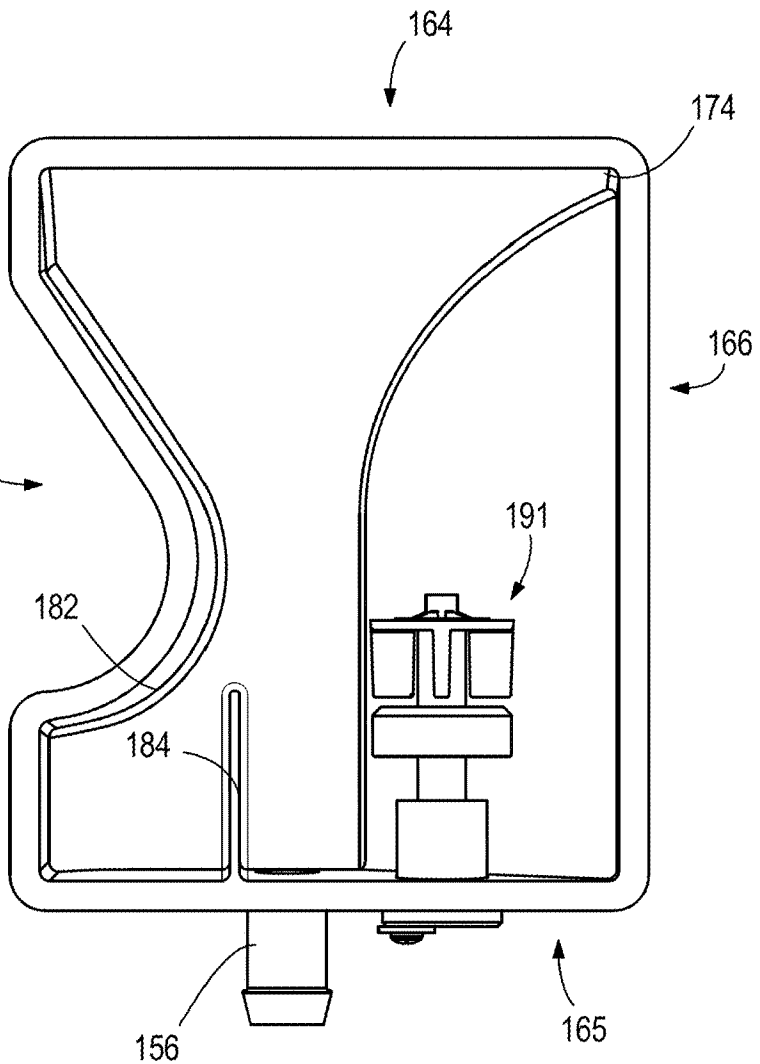
FIG. 28 is a view of the inside of the port clamshell portion.
Figure 27:
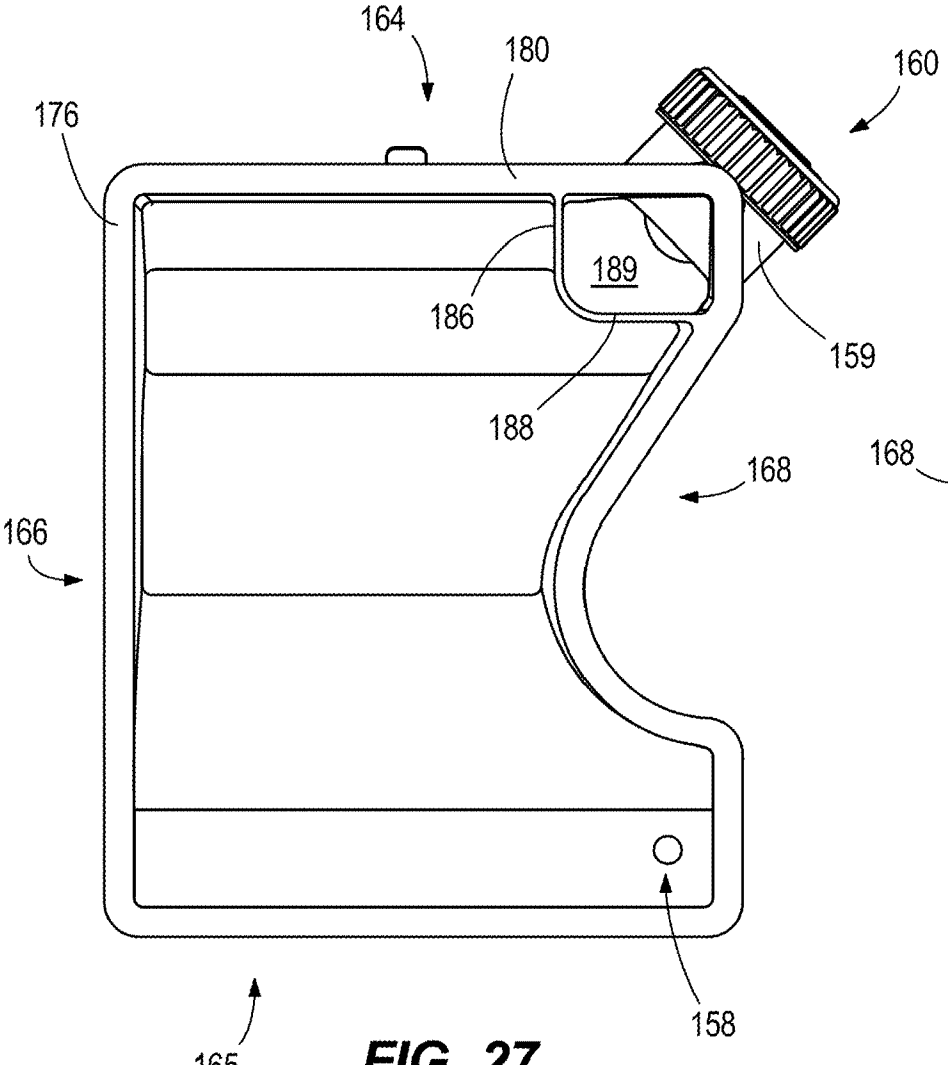
FIG. 27 is a view of the inside of the starboard clamshell portion.

Referring to FIG. 24, a vertical fill line 190 is located on the reservoir 152 and designates maximum and minimum fill levels for the hydraulic fluid. The housing 62 can be made of a transparent material to assist viewing of the level of hydraulic fluid inside the reservoir 52. The vertical fill line 190 and vent opening 160 are positioned relative to each other so that the vent opening 160 does not become covered by the hydraulic fluid when the outboard motor 120 is trimmed into and out of the raised and lowered position. Referring to FIGS. 26 and 28, an electronic fluid level sensor 191 is located inside of the housing 162 and is configured to sense the level of the hydraulic fluid and communicate the sensed level to, for example, a controller associated with the outboard motor 120 and/or marine vessel 122. The type and configuration of electronic fluid level sensor can vary from what is shown. Suitable examples are available from Mercury Marine, part number 8M0096778. Other industry examples include a fluid level sensing reed switch from Grainger.

Figure 30:
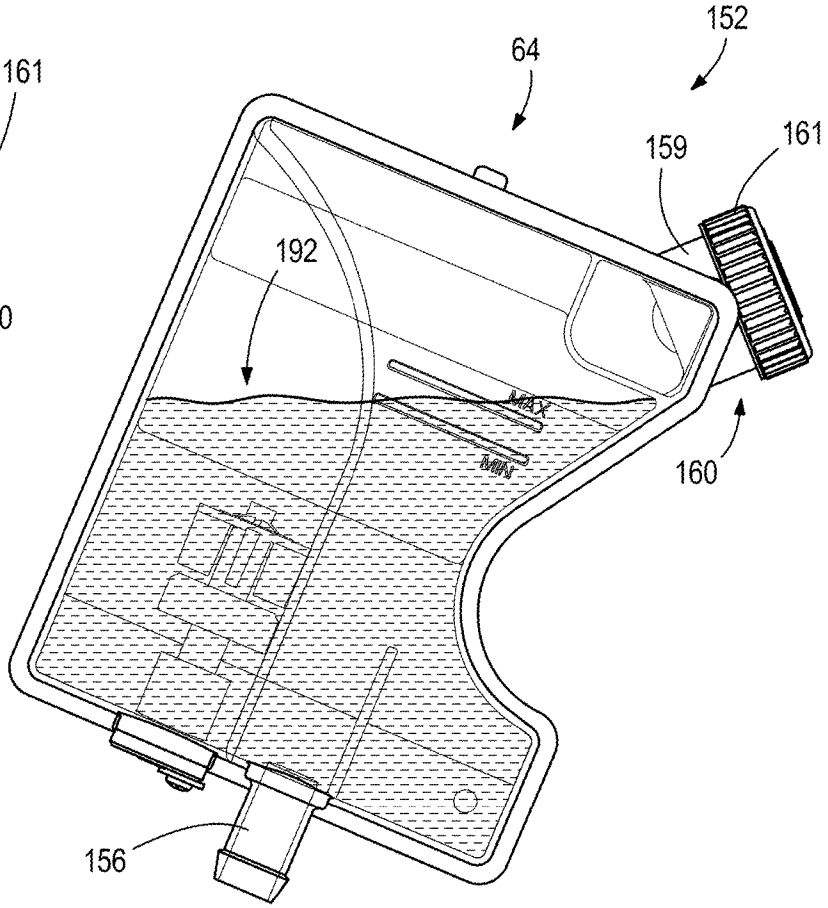
FIGS. 29-32 are sectional views of the reservoir at various trim angles
Figure 29:
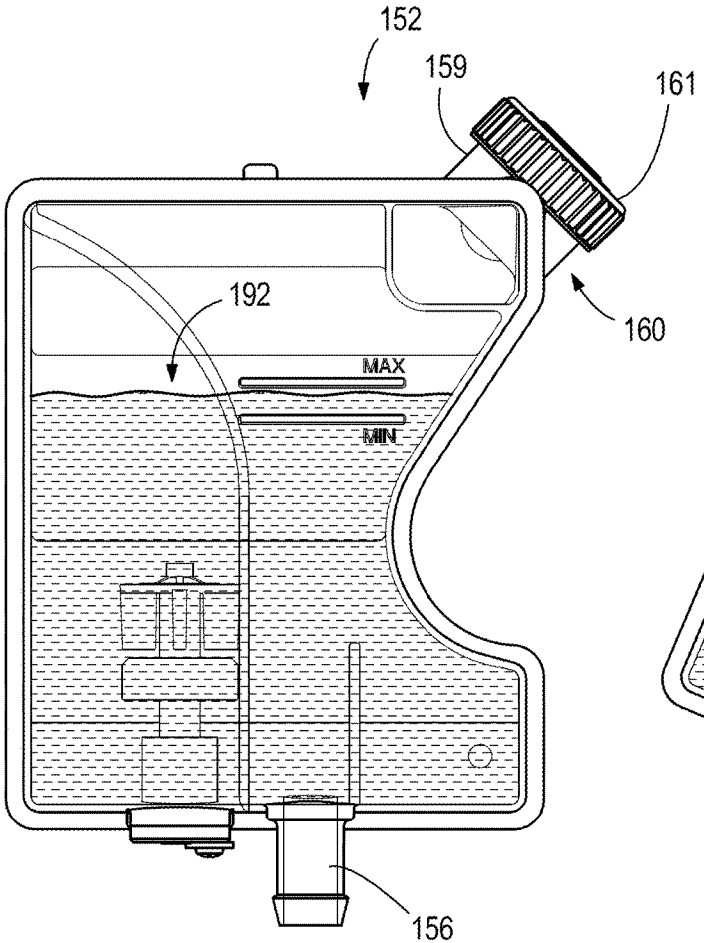
Figure 32:
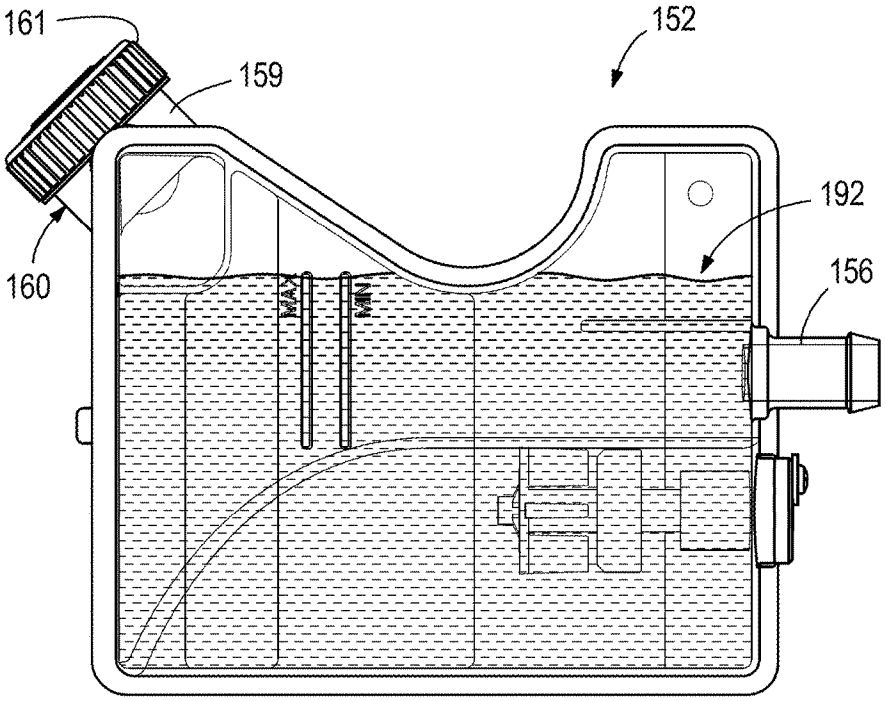
Figure 31:
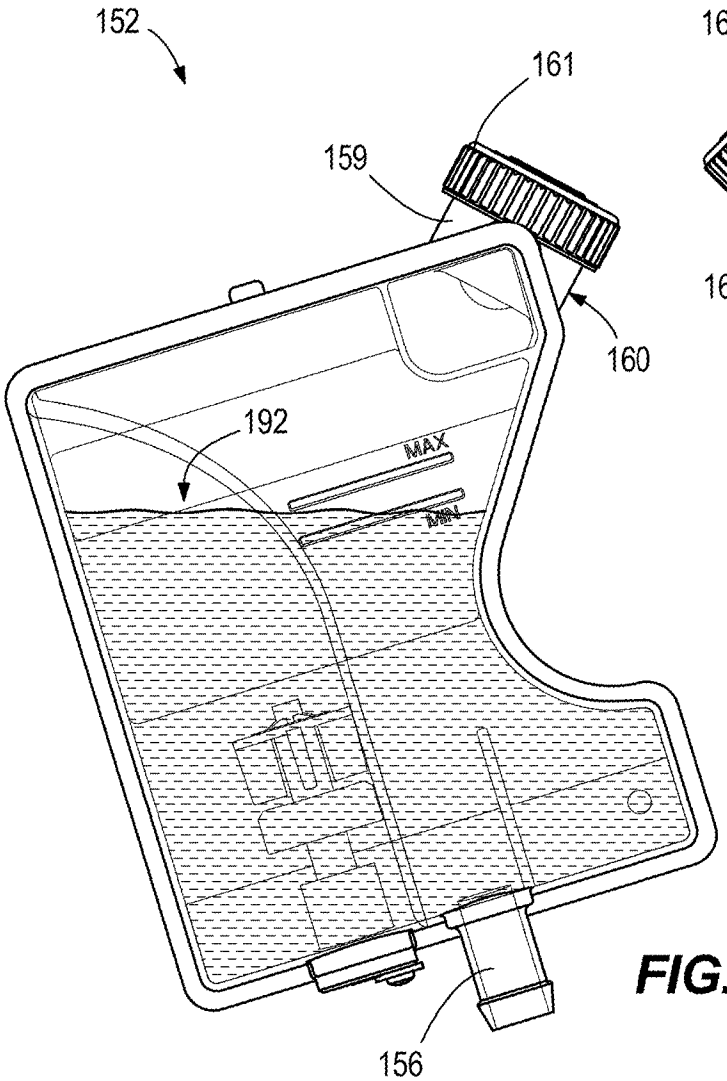

Referring to FIGS. 29-32, the reservoir 152 is specially configured so that top surface 192 of the hydraulic fluid in in the housing 162 does not cover the vent opening 160 during the various operational positions of the outboard motor 120. FIG. 29 depicts the reservoir 152 while the outboard motor 120 is in a level position, such as shown in FIG. 17. The hydraulic fluid in the reservoir 152 settles by gravity such that the top surface 192 is generally horizontal and located vertically below the vent opening 60. FIG. 30 depicts the reservoir 152 while the outboard motor 120 is in a tucked position (i.e. a trimmed down position in which the outboard motor 120 is tucked twenty-three degrees from vertical orientation). The hydraulic fluid in the reservoir 152 settles by gravity such that the top surface remains generally horizontal and is still vertically below the vent opening 160. FIG. 31 depicts the reservoir 152 while the outboard motor 120 is in a trimmed up position (i.e., a trimmed up position in which the outboard motor is trimmed up seventeen degrees from vertical orientation). The hydraulic fluid settles by gravity such that the top surface 192 remains below the vent opening 160. Finally, FIG. 32 depicts the reservoir 152 when the outboard motor 120 is placed in a storage position in which the outboard motor 120 is laid down on its forward side. As shown, the hydraulic fluid settles by gravity such that the top surface 192 remains below the vent opening 160.

Advantageously, the shape of the reservoir 52, 152 and most notably the position of the fill neck 59, 159 are configured such that the hydraulic fluid does not cover the cap 61, 161 for any extended period of time. The vented cap 61, 161 allows air to escape the housing 62, 162 and retains fluid in a splash-proof design. The vented reservoir 52, 152 advantageously allows for expansion and contraction of hydraulic fluid during changing pressures and temperatures.

Although specific advantages have been enumerated above, various embodiments may include some, none, or all of the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. An outboard motor for propelling a marine vessel in water, the outboard motor extending vertical direction, a longitudinal direction that is perpendicular to the vertical direction, and a transverse direction that is perpendicular to the vertical direction and perpendicular to the longitudinal direction, wherein the outboard motor can be trimmed about a trim axis into and between a raised position in which the outboard motor is fully trimmed up out of the water and a lowered position in which the outboard motor is fully trimmed down into the water, the outboard motor comprising:

a hydraulic steering actuator for steering the outboard motor about steering axis;

a reservoir mounted on the outboard motor for containing hydraulic fluid for the hydraulic steering actuator;

a reservoir outlet via which the hydraulic fluid is supplied to the hydraulic steering actuator and a reservoir inlet via which the hydraulic fluid is returned to the reservoir; and a vent opening that vents the reservoir to atmosphere, the vent opening being located on the reservoir closer to the back of the outboard motor than the front of the outboard motor so that the vent opening does not become covered by the hydraulic fluid when the outboard motor is trimmed into and out of the raised and lowered positions.

2. The outboard motor according to claim 1, wherein when the reservoir has a housing that extends from top to bottom in the vertical direction, from front to back in the longitudinal direction, and from port side to starboard side in the transverse direction, and wherein the vent opening is located on the top of the reservoir and closer to the back of the reservoir than the front of the reservoir.

3. The outboard motor according to claim 2, wherein the vent opening is located at a corner of the reservoir.

4. The outboard motor according to claim 2, further comprising the hydraulic fluid in the reservoir, wherein the hydraulic fluid fills the reservoir up to a vertical fill line that is below the vent opening.

5. The outboard motor according to claim 4, wherein the hydraulic fluid has a top surface, and wherein the vent opening is located with respect to the vertical fill line so that the top surface remains below the vent opening when the outboard motor is trimmed into and out of the raised and lowered positions.

6. The outboard motor according to claim 5, further comprising a plurality of splash baffles in the reservoir, the plurality of splash baffles diverting splashes of the hydraulic fluid away from the vent opening when the reservoir is agitated.

7. The outboard motor according to claim 6, wherein the plurality of splash baffles comprises a first baffle extending downwardly from the top of the housing and a second baffle transversely extending from the first baffle towards the back of the housing.

8. The outboard motor according to claim 5, further comprising at least one flow separation baffle in the reservoir, the flow separation baffle diverting hydraulic fluid from the reservoir inlet away from the reservoir outlet.

9. The outboard motor according to claim 8, wherein the reservoir inlet is located at or adjacent to the bottom of the reservoir and wherein the plurality of flow separation baffles comprises a first flow separation baffle transversely extending from the back of the housing and a second flow separation baffle extending up from the bottom of the housing past the first flow separation baffle so as to define a space for the hydraulic fluid to flow further into the housing.

10. The outboard motor according to claim 9, wherein the front of the reservoir is coupled to a pump that is configured to pump the hydraulic fluid from the reservoir to the hydraulic steering actuator.

11. The outboard motor according to claim 10, wherein the reservoir outlet is located at the front of the reservoir.

12. The outboard motor according to claim 2, wherein the housing is a clamshell housing having first and second clamshell portions that are coupled together along a perimeter.

13. The outboard motor according to claim 12, wherein the reservoir inlet extends through the first clamshell portion and not through the second clamshell portion and wherein the vent opening extends through the second clamshell portion and not the first clamshell portion.

14. The outboard motor according to claim 12, wherein the vent opening extends through the second clamshell portion, and further comprising a plurality of splash baffles in the second clamshell portion but not in the first clamshell portion, the plurality of splash baffles diverting the hydraulic fluid away from the vent opening when the reservoir is agitated.

15. The outboard motor according to claim 12, wherein the reservoir outlet and reservoir inlet each extend through the first clamshell portion, and further comprising at least one flow separation baffle in the first clamshell portion but not in the second clamshell portion, the flow separation baffle diverting hydraulic fluid away from the reservoir outlet.

16. The outboard motor according to claim 1, further comprising an electronic fluid level sensor that senses hydraulic fluid levels in the reservoir.

17. A reservoir for a hydraulic steering actuator on an outboard motor, the reservoir comprising:

a housing that extends from top to bottom in a vertical direction, from front to back in a longitudinal direction that is perpendicular to the vertical direction, and from port side to starboard side in a transverse direction that is perpendicular to the vertical direction and perpendicular to the longitudinal direction;

a reservoir outlet via which the hydraulic fluid is supplied to the hydraulic steering actuator and a reservoir inlet via which the hydraulic fluid is returned to the reservoir;

a vent opening that vents the reservoir to atmosphere, the vent opening being located on top of the housing and closer to the back of the housing than the front of the outboard motor so that the vent opening does not become covered by the hydraulic fluid when the outboard motor is trimmed into and out of the raised and lowered positions;

wherein the hydraulic fluid fills the reservoir to a vertical fill line that is below the vent opening, wherein the hydraulic fluid has a top surface along the vertical fill line, and wherein the vent opening is positioned with respect to the vertical fill line so that the vent opening remains above the top surface when the outboard motor is trimmed into and out of the raised and lowered position.

18. The reservoir according to claim 17, further comprising a plurality of splash baffles in the reservoir, the plurality of splash baffles diverting the hydraulic fluid away from the vent opening when the reservoir is agitated, wherein the plurality of splash baffles comprises a first baffle extending downwardly from the top of the housing and a second baffle transversely extending from the first baffle towards the back of the housing.

19. The reservoir according to claim 18, further comprising at least one flow separation baffle in the reservoir, the flow separation baffle diverting hydraulic fluid from the reservoir inlet away from the reservoir outlet.

20. The reservoir according to claim 19, wherein the reservoir comprises a clamshell housing having first and second clamshell portions that are coupled together along a perimeter, and wherein the reservoir outlet, reservoir inlet and vent opening each extend through the first clamshell portion and not through the second clamshell portion.

* * * * *